US006022160A

United States Patent [19]

Sakurai

[11] Patent Number: 6,022,160

[45] Date of Patent: Feb. 8, 2000

[54] CASE OF STICK-TYPE COSMETIC PREPARATION AND REPLACEABLE CARTRIDGE OF STICK-TYPE COSMETIC PREPARATION USED THEREFOR

[75] Inventor: Tomio Sakurai, Nagoya, Japan

[73] Assignee: Nonogawa Shoji, Ltd., Nagoya, Japan

[21] Appl. No.: 09/274,092

[22] Filed: Mar. 22, 1999

Related U.S. Application Data

[62] Division of application No. 08/836,192, May 9, 1997.

[30] Foreign Application Priority Data

| | | | |
|---|---|---|---|
| Sep. 14, 1995 | [JP] | Japan | 7-262205 |
| Apr. 22, 1996 | [JP] | Japan | 8-126358 |
| May 21, 1996 | [JP] | Japan | 8-150321 |

[51] Int. Cl.[7] ..... B43K 21/10

[52] U.S. Cl. ..... 401/64; 401/63; 401/49; 401/55

[58] Field of Search ..... 401/60, 55, 56, 401/57, 63, 70, 64, 87, 59

[56] References Cited

U.S. PATENT DOCUMENTS

| | | | |
|---|---|---|---|
| 3,036,702 | 5/1962 | Davis | 401/63 |
| 3,082,869 | 3/1963 | Bau | 401/63 |
| 3,343,668 | 9/1967 | Politzer | 401/63 |
| 3,348,670 | 10/1967 | Bau | 401/63 |
| 4,973,178 | 11/1990 | Kakuta et al. . | |

FOREIGN PATENT DOCUMENTS

| | | |
|---|---|---|
| 995246 | 11/1951 | France . |
| 1-101420 | of 0000 | Japan . |
| 1-101421 | of 0000 | Japan . |
| 1-82819 | of 0000 | Japan . |
| 2-102112 | of 0000 | Japan . |
| 3-34415 | of 0000 | Japan . |
| 4-77813 | of 0000 | Japan . |
| 54-34214 | of 0000 | Japan . |
| 55-50618 | of 0000 | Japan . |
| 56-60507 | of 0000 | Japan . |
| 57-45812 | of 0000 | Japan . |
| 58-106015 | of 0000 | Japan . |
| 58-109408 | of 0000 | Japan . |
| 58-112214 | of 0000 | Japan . |
| 58-112217 | of 0000 | Japan . |
| 58-77612 | of 0000 | Japan . |
| 58-80920 | of 0000 | Japan . |
| 58-86018 | of 0000 | Japan . |
| 58-88913 | of 0000 | Japan . |
| 58-88914 | of 0000 | Japan . |
| 59-95917 | of 0000 | Japan . |
| 60-113716 | of 0000 | Japan . |
| 60-126112 | of 0000 | Japan . |
| 60-40209 | of 0000 | Japan . |

(List continued on next page.)

OTHER PUBLICATIONS

Patent Office Journal No. 1015, Dec. 1963, New Zealand Patent No. NZ 131528, Silson et al., Entitled, "Cosmetic Lipstick Dispenser, Push Button Operated", Mar. 5, 1962.

Patent Office Journal No. 1013, Oct. 1961, New Zealand Patent No. NZ 129335, Gruska, Entitled, "Lipstick Case, Rotating to Project", May 23, 1961.

*Primary Examiner*—David J. Walczak

*Attorney, Agent, or Firm*—Beyer & Weaver, LLP

[57] ABSTRACT

A case for a stick-type cosmetic preparation which enables selective protrusion and retraction from and into the case. The case includes a main body having an elongated bore dimensioned for sliding receipt of the cosmetic preparation therein, and a cover hingedly mounted to an end of the main body to open and close access to the bore. The case further includes a sleeve coupled between the main body and the cosmetic preparation that slides up and down a longitudinal axis of the main body in a manner contacting the cover, for opening thereof, prior to protrusion of the stick-type cosmetic preparation from the bore. A lifting mechanism is coupled to the sleeve for selective reciprocating movement of the sleeve and the stick-type cosmetic preparation in the bore of the case.

31 Claims, 23 Drawing Sheets

FOREIGN PATENT DOCUMENTS

| | | |
|---|---|---|
| 60-80720 | of 0000 | Japan . |
| 60-86213 | of 0000 | Japan . |
| 61-134716 | of 0000 | Japan . |
| 61-134717 | of 0000 | Japan . |
| 61-151607 | of 0000 | Japan . |
| 62-178918 | of 0000 | Japan . |
| 62-69935 | of 0000 | Japan . |
| 58-163113 | 10/1983 | Japan . |
| 59-75206 | 5/1984 | Japan . |
| 63-31607 | 2/1988 | Japan . |
| 153873 | of 0000 | Taiwan . |

CASE OF STICK-TYPE COSMETIC PREPARATION AND REPLACEABLE CARTRIDGE OF STICK-TYPE COSMETIC PREPARATION USED THEREFOR

This is a divisional application of prior application Ser. No. 08/836,192 filed on May 9, 1997 the disclosure of which is incorporated herein by reference.

BACKGROUND OF THE INVENTION

1. Field of the Invention

The present invention relates to a case of stick-type cosmetic preparation, which enables a stick-type cosmetic preparation to be readily protruded from and received into the case, and also to a replaceable cartridge of stick-type cosmetic preparation used therefor.

2. Description of the Related Art

Prior art cases of stick-type cosmetic preparation are, for example, disclosed in JAPANESE UTILITY MODEL LAYING-OPEN GAZETTE Nos. 58-12214, 1-82819, and 3-34415. These known cases of stick-type cosmetic preparation have a structure that enables a stick-type cosmetic preparation to be protruded from and received into the case in response to a sliding operation of a predetermined operating member. A sliding operation of the predetermined operating member opens and closes an opening of the case, through which the stick-type cosmetic preparation is lifted up and down. This structure makes the stick-type cosmetic preparation ready for application by a single sliding operation of the operating member.

In the conventionally known cases of stick-type cosmetic preparation, however, the stick-type cosmetic preparation set in the case is exposed to the inner wall of the case, except its lower end portion supported by a predetermined support member. There is accordingly a fear that the stick-type cosmetic preparation may come into contact with and be damaged by the opening or the inner wall of the case while stationary or during upward or downward movement of the stick-type cosmetic preparation. In the structures disclosed in the above references, a cover is set in the case while the stick-type cosmetic preparation is protruded from the case. This makes the case undesirably bulky.

The prior art cases of stick-type cosmetic preparation having the structure that allows the stick-type cosmetic preparation to be protruded from the case by a single operation are used only once and thrown away after the stick-type cosmetic preparation has been used up. With the growing concern about the environmental and resource-saving issues, the demand for replacing the contents of daily products and making their cases reusable has been heightened significantly. The cases of daily consumed cosmetic preparation are no exception with this demand.

Some replaceable stick-type cosmetic preparations with reusable cases are commercially available, from for example, Meteorite Lipsticks by Guerlain. These replaceable stick-type cosmetic preparations have a separate cap, which is to be removed during use. This structure makes it impossible to prepare the stick-type cosmetic preparation for application by a single operation. A complicated structure is generally required to make the stick-type cosmetic preparation ready for application by a single operation. The complicated structure of the case results in a complicated attachment mechanism of the stick-type cosmetic preparation. When the structure of the attachment mechanism becomes too complicated, the users can not attach and detach the stick-type cosmetic preparation to and from the case by themselves. There have been no cases of stick-type cosmetic preparation having a structure that enables a replaceable stick-type cosmetic preparation to be freely attached to and detached from a compact and reusable case and makes the stick-type cosmetic preparation ready for application by a single operation, while effectively protecting the stick-type cosmetic preparation from damages.

SUMMARY OF THE INVENTION

One object of the present invention is thus to provide a case of stick-type cosmetic preparation having a structure that protects a stick-type cosmetic preparation from damages and makes the stick-type cosmetic preparation ready for application by a single operation.

Another object of the present invention is to provide a case of stick-type cosmetic preparation having a structure that enables a replaceable stick-type cosmetic preparation to be readily attached to and detached from a reusable case.

Still another object of the present invention is to provide a replaceable cartridge of stick-type cosmetic preparation used for such a case.

The above and the other related objects are realized by a first case of stick-type cosmetic preparation for accommodating a stick-type cosmetic preparation therein to enable the stick-type cosmetic preparation to be freely protrudable from the case. The first case of stick-type cosmetic preparation of the present invention includes: a main body including a tube with an opening on one end thereof; a sleeve for receiving a protruding end portion of the stick-type cosmetic preparation therein, the sleeve being received in the tube of the main body to be freely protrudable from the tube; a support member arranged inside the sleeve for supporting a lower portion of the stick-type cosmetic preparation; and lifting means comprising an operating member attached to the main body to be slidingly movable, a belt having a first end fixed to the operating member and a second end connecting with the sleeve and the support member, and a transmitting mechanism for transmitting a sliding operation of the operating member to slide up and down the sleeve along a longitudinal axis of the tube via the belt, the transmitting mechanism sliding up the sleeve preceding an upward movement of the stick-type cosmetic preparation kept therein until the sleeve reaches the opening of the tube and further sliding up the stick-type cosmetic preparation to a position that enables the protruding end portion of the stick-type cosmetic preparation to be protruded from the sleeve and the opening of the tube.

In the first case of stick-type cosmetic preparation of the present invention, the sleeve is accommodated in the tube of the main body to be freely protrudable from the tube, whereas the support member with a stick-type cosmetic preparation supported thereby is arranged inside the sleeve. A sliding operation of the operating member of the lifting means lifts up and down the sleeve via the belt while lifting up and down the stick-type cosmetic preparation supported by the support member. The transmitting mechanism of the lifting means slides up and down both the sleeve and the stick-type cosmetic preparation via the belt. In accordance with a concrete procedure, the transmitting mechanism slides up the sleeve preceding an upward movement of the stick-type cosmetic preparation until the sleeve reaches the opening of the tube, and then slides up the stick-type cosmetic preparation to a position that enables the protruding end portion of the stick-type cosmetic preparation to be protruded from the sleeve and the opening of the tube. At least the protruding end portion of the stick-type cosmetic preparation is received in the sleeve, which is placed inside the main body. This structure effectively prevents the stick-type cosmetic preparation from being pressed against and damaged by the wall face of the tube of the main body, when the stick-type cosmetic preparation is slid up or down.

In accordance with one preferable application of the first case of stick-type cosmetic preparation of the present invention, the transmitting mechanism of the lifting means holds the sleeve at a predetermined position, for example, at a position where the protruding end of the sleeve projects over the opening, after sliding forward the sleeve via the belt in response to a sliding operation of the operating member, and enables the stick-type cosmetic preparation to be lifted up together with the support member while the sleeve is in a stationary condition.

In accordance with another preferable application, the transmitting mechanism of the lifting means moves the stick-type cosmetic preparation at a predetermined sliding rate, which is greater than a sliding rate of the sleeve. For example, the sliding force of the operating member is transmitted to the sleeve via a single-start thread while being transmitted to the stick-type cosmetic preparation via a double-start thread. This makes the sliding rate of the stick-type cosmetic preparation greater than the sliding rate of the sleeve, thereby enabling the protruding end portion of the stick-type cosmetic preparation to be protruded from the sleeve after the sleeve is protruded from the opening of the main body.

The transmitting mechanism may alternatively utilize a spring force or another similar force as long as the structure can transmit the operating force of the operating member to the sleeve or the support member. According to one possible structure, for example, when the sleeve is shifted to a predetermined position by the operation of the operating member, the restriction on the movement of the stick-type cosmetic preparation is released and the spring force is applied to make the stick-type cosmetic preparation project over the sleeve.

In accordance with one preferable embodiment of the present invention, the transmitting mechanism of the lifting means may be realized by a cam mechanism having first guide means and second guide means. In the first guide means of this preferable embodiment, an engagement element formed on the main body moves along a guide element, such as a cam groove, formed on the sleeve. When the engagement element on the main body reaches a cam element formed on one end of the guide element on the sleeve, the movement of the sleeve is restricted. A connection pin of the second guide means for connecting and fixing the second end of the belt to the support member is guided by a guide groove to make the support member slidingly movable, while the movement of the sleeve is restricted. The sliding movement of the support member enables the stick-type cosmetic preparation to be protruded from the sleeve.

The first guide means may have the reverse configuration to attain the same functions and effects. Namely, the first guide means may include an engagement element formed on the sleeve and a guide element formed on the main body, instead of the engagement element formed on the main body and the guide element formed on the sleeve.

According to one preferable embodiment of the present invention, the operating member and a hinge for joining a cover with the main body, both of which protrude from the main body, are arranged on the same side of the main body. The other side of the main body accordingly does not have any protrusions but has a smooth surface. This structure improves the design effects of the main body.

In accordance with one preferable embodiment, the first case of stick-type cosmetic preparation of the present invention further includes a cover that is attached to the opening of the main body via a hinge. In this case, the transmitting mechanism of the lifting means has a structure that enables a protruding end of the sleeve to press against and open the cover. This structure requires no additional operation for opening the cover and is thus convenient in use. Any structure that forms the hinge may be applied to open and close the cover with respect to the opening of the main body; for example, a structure that supports the cover to allow pivotal movement thereof around a shaft or that pivotally supports the cover via a connection unit formed integrally with or separately from the main body.

The hinge may have a structure that applies a spring force to the cover in its closing direction. This structure does not require an additional operation for closing the cover and further improves the convenience in use.

In accordance with another preferable embodiment of the first case of stick-type cosmetic preparation of the present invention, one end of the belt is formed as a cover for opening and closing the opening of the main body. This structure having no separate cover reduces the number of required parts.

The present invention is also directed to a second case of stick-type cosmetic preparation, wherein the lifting means includes an operating member and a transmitting mechanism. An operation of the operating member is transmitted via the transmitting mechanism and enables a protruding end of the sleeve to press-open the cover, without bringing the stick-type cosmetic preparation into contact with the cover. The lifting means of the second case may have a variety of configurations. For example, although the operating member is slidingly operated with respect to the main body in the embodiments of the present invention, the operating member may be operated in any other desirable manner, such as rotating or pressing, as long as an external force is applicable to the sleeve.

The present invention further relates to a third case of stick-type cosmetic preparation including a support member for supporting a stick-type cosmetic preparation, a sleeve for receiving a protruding end portion of the stick-type cosmetic preparation therein, and a main body having an opening on one end thereof. The main body has a tube, in which the sleeve and the support member with the stick-type cosmetic preparation supported thereby are accommodated. The third case further includes: a lifting mechanism comprising a movable unit moving in response to a predetermined operating force applied externally, an interlocking unit for transmitting the movement of the movable unit to the support member and the sleeve, and a transmitting unit for making the support member and the sleeve slide up and down in the tube along a longitudinal axis of the main body in response to the movement of the movable unit transmitted by the interlocking unit and for enabling a protruding end portion of the stick-type cosmetic preparation to be protruded from the sleeve and the opening of the main body; and an attachment mechanism for enabling a predetermined section including the stick-type cosmetic preparation to be attached to and detached from the main body by connecting and separating predetermined elements of a joint unit included in the lifting mechanism with and from each other.

In the third case of stick-type cosmetic preparation according to the present invention, the movable unit moves when receiving a predetermined operating force, and the interlocking unit transmits the movement of the movable unit to the support member for supporting the stick-type cosmetic preparation and the sleeve for receiving at least the protruding end portion of the stick-type cosmetic preparation. In response to the movement of the movable unit transmitted by the interlocking unit, the support member and the sleeve slide up and down in the tube along a longitudinal axis of the main body, so that the protruding end portion of the stick-type cosmetic preparation is protruded from the sleeve and the opening of the main body. A predetermined section including the stick-type cosmetic preparation is attached to and detached from the main body by connecting and separating predetermined elements of a joint unit included in the lifting mechanism with and from each other.

In the third case of stick-type cosmetic preparation having the above structure, when the user applies a predetermined operating force to the movable unit, the protruding end portion of the stick-type cosmetic preparation is protruded from the sleeve and the opening of the main body and quickly made ready for application. Constituents of a joint unit included in the lifting mechanism for realizing protrusion of the stick-type cosmetic preparation are joined with and separated from each other, so that a predetermined section including the stick-type cosmetic preparation can be attached to and detached from the main body. This structure enables the predetermined section including the used-up stick-type cosmetic preparation to be replaced by a new one, and the main body is thus reusable with the new stick-type cosmetic preparation. In the third case of stick-type cosmetic preparation of the invention, at least the protruding end portion of the stick-type cosmetic preparation is received in the sleeve, which is further accommodated in the main body. Even when some impact is applied onto the case of stick-type cosmetic preparation in carriage, this structure effectively protects the protruding end portion of the stick-type cosmetic preparation from damages in the case.

In accordance with one preferable application of the invention, the third case of stick-type cosmetic preparation may have a first structure, wherein the interlocking unit is a belt connected with the movable unit and arranged at a predetermined position in the main body to be freely movable in a sliding manner for directly transmitting a moving distance of the movable unit, and the transmitting unit further includes first guide means and second guide means. The first guide means is provided with: an engagement element formed on the sleeve; a mated engaging element formed on the main body along the longitudinal axis of the main body for sliding the engagement element according to the shape of the mated engaging element and thereby enabling the sleeve to reciprocate along the longitudinal axis of the main body; and a cam element formed on one end of the mated engaging element for guiding the engagement element to rotate the sleeve in a predetermined direction prior to restricting a movement of the sleeve. The second guide means has a structure that enables the support member with the stick-type cosmetic preparation supported thereby to slide in response to the movement of the movable unit, after the movement of the sleeve has been restricted.

In this first structure, a predetermined operating force applied to the movable unit is transmitted as the moving distance of the movable unit to the sleeve and the support member via the belt, which is arranged at a predetermined position in the main body to be movable in a sliding manner. When the predetermined operating force is transmitted via the belt, the engagement element formed on the sleeve slides according to the shape of the mated engaging element formed on the main body along the longitudinal axis of the main body, so that the sleeve reciprocates along the longitudinal axis of the main body. The engagement element on the sleeve is guided by the cam element formed on one end of the mated engaging element on the main body. This rotates the sleeve in a predetermined direction while restricting the subsequent movement of the sleeve. Once the movement of the sleeve is restricted, the support member with the stick-type cosmetic preparation supported thereby is slid in response to the movement of the movable unit.

In the third case of stick-type cosmetic preparation having the first structure, the predetermined operating force transmitted via the belt first shifts the sleeve by means of the first guide means, and then slides the support member by means of the second guide means after the movement of the sleeve is restricted. The structure that slides the sleeve and then the support member enables the stick-type cosmetic preparation to be eventually protruded from the sleeve and the opening of the main body.

It is preferable that the third case of stick-type cosmetic preparation further include a second structure, wherein the second guide means has a connecting protrusion for connecting a predetermined position of the belt with the support member, and a guide groove formed along a longitudinal axis of the sleeve for guiding the connecting protrusion. The guide groove further includes an engagement slot for receiving the connecting protrusion in an engaging manner and enabling the engagement of the connecting protrusion to be released by the rotation of the sleeve, and a guide slot for guiding the connecting protrusion to slide the support member relative to the sleeve while the movement of the sleeve is being restricted.

In the third case of stick-type cosmetic preparation having the second structure, while the sleeve is slid by means of the first guide means, the connecting protrusion for connecting the belt with the support member is fitted in the engagement slot of the guide groove formed on the sleeve. This enables the support member to move in a sliding manner together with the sleeve. Once the movement of the sleeve is restricted, the engagement of the connecting protrusion is released, and the support member is accordingly slid relative to the sleeve. The protruding end portion of the stick-type cosmetic preparation, which slides in the tube of the main body, is continuously protected by the sleeve until the stick-type cosmetic preparation becomes projecting over the sleeve.

In accordance with another preferable application, the third case of stick-type cosmetic preparation may further include a third structure, wherein the connecting protrusion is formed to connect with the support member, and the attachment mechanism enables the sleeve and the support member with the stick-type cosmetic preparation supported thereby to be attached to or detached from the main body by joining or separating the engagement element on the sleeve and the connecting protrusion with or from the mated engaging element on the main body and the predetermined position of the belt, respectively.

In this third structure, the engagement element on the sleeve and the connecting protrusion connecting with the support member are respectively joined with or separated from the mated engaging element on the main body and the predetermined position of the belt, so that the support member and the sleeve can be attached to and detached from the main body.

It is further preferable that at least one of the engagement element and the connecting protrusion be arranged on a resilient structure formed on the sleeve or the support member. In this case, at least either one of the engagement element on the sleeve and the connecting protrusion has sufficient resilience. This allows the support member and the sleeve to be readily attached to and detached from the main body with a moderate touch.

In accordance with another preferable application of the present invention, the main body of the third case of stick-type cosmetic preparation further includes: a first guide cut for guiding the connecting protrusion linked with the support member from the opening of the main body to a position in the vicinity of the predetermined position of the belt; and a second guide cut for guiding the engagement element on the sleeve from the opening of the main body into the tube of the main body.

When the sleeve and the support member for supporting the stick-type cosmetic preparation are attached to the main body, the connecting protrusion and the engagement element on the sleeve having predetermined resilience are respectively pressed against the first guide cut and the second guide cut while being guided in the tube of the main body by means of the first guide cut and the second guide cut. By adjusting the connecting protrusion and the engagement element on the sleeve to the first guide cut and the second guide cut, the sleeve and the support member can readily be pressed into the tube and thereby attached to the main body.

It is preferable that the first guide cut have a projection in the vicinity of the predetermined position of the belt.

In the process of pressing the connecting protrusion into the tube along the first guide cut, this structure enables the connecting protrusion having predetermined resilience to be first pressed according to the shape of the projection and then pressed back by its resilience when the connecting protrusion reaches the predetermined position of the belt. The connecting protrusion is accordingly fitted into the predetermined position of the belt with a moderate touch.

It is also preferable that the first guide cut and the second guide cut be arranged corresponding to a distance between the engagement element on the sleeve and the connecting protrusion fitted in the engagement slot of the guide groove.

This structure allows the sleeve and the support member with the stick-type cosmetic preparation supported thereby to be attached to the main body, while the connecting protrusion is held in the engagement slot of the guide groove. The engagement of the connecting protrusion with the engagement slot effectively prevents the support member for supporting the stick-type cosmetic preparation from mistakenly sliding and damaging the protruding end portion and the other portions of the stick-type cosmetic preparation, in the process of attachment.

According to another aspect of the present invention, in the third case of stick-type cosmetic preparation, the interlocking unit is a belt connected with the movable unit and arranged at a predetermined position in the main body to be freely movable in a sliding manner, and the transmitting unit is further provided with first guide means and second guide means. The first guide means includes: an engagement element formed on the main body; a mated engaging element formed on the sleeve along a longitudinal axis of the sleeve for sliding the engagement element according to the shape of the mated engaging element and thereby enabling the sleeve to reciprocate along the longitudinal axis of the sleeve; and a cam element formed on one end of the mated engaging element for guiding the engagement element to rotate the sleeve in a predetermined direction prior to restricting a movement of the sleeve. The second guide means has a structure that enables the support member with the stick-type cosmetic preparation supported thereby to slide in response to the movement of the movable unit, after the movement of the sleeve has been restricted.

In the third case of stick-type cosmetic preparation thus constructed, a predetermined operating force applied to the movable unit is transmitted to the sleeve and the support member via the belt, which is arranged at a predetermined position in the main body to be movable in a sliding manner. When the predetermined operating force is transmitted via the belt, the engagement element formed on the main body slides according to the shape of the mated engaging element formed on the sleeve along the longitudinal axis of the sleeve, so that the sleeve reciprocates along the longitudinal axis of the sleeve. The engagement element on the main body is guided by the cam element formed on one end of the mated engaging element on the sleeve. This rotates the sleeve in a predetermined direction while restricting the subsequent movement of the sleeve. Once the movement of the sleeve is restricted, the support member with the stick-type cosmetic preparation supported thereby is slid in response to the movement of the movable unit.

In the third case of stick-type cosmetic preparation having the above structure, the predetermined operating force transmitted via the belt first shifts the sleeve by means of the first guide means, and then slides the support member by means of the second guide means after the movement of the sleeve is restricted. The structure that slides the sleeve and then the support member enables the stick-type cosmetic preparation to be eventually protruded from the sleeve and the opening of the main body.

According to one preferable structure of the third case of stick-type cosmetic preparation, the lifting mechanism is constructed to slide up the sleeve preceding an upward movement of the stick-type cosmetic preparation kept therein until the sleeve reaches at least the opening of the main body. The sleeve protects the protruding end portion of the stick-type cosmetic preparation until the sleeve reaches at least the opening of the tube. This structure effectively prevents the protruding end portion of the stick-type cosmetic preparation from being damaged by the main body and its opening.

This function can be realized by one preferable structure, wherein the transmitting unit of the lifting mechanism transmits the movement of the movable unit via the interlocking unit to slidingly move the sleeve to a predetermined position, further moves the support member with the stick-type cosmetic preparation supported thereby while the sleeve remains at the predetermined position, and enables the stick-type cosmetic preparation to be protruded from the sleeve and the opening of the main body.

The function may alternatively be realized by another preferable structure, wherein the transmitting unit of the lifting mechanism moves up or down the stick-type cosmetic preparation at a predetermined sliding rate, which is greater than a sliding rate of the sleeve.

According to another aspect of the present invention, the third case of stick-type cosmetic preparation further includes a cover attached to the opening of the main body via a predetermined joint element to freely open and close the opening, and the lifting mechanism is constructed to allow a protruding end of the sleeve to press-open the cover.

In this structure, prior to the stick-type cosmetic preparation, the sleeve reaches the opening of the main body and press-opens the cover. A predetermined operation of the movable unit makes the stick-type cosmetic preparation protruded from the main body, concurrently with opening the cover. This structure effectively prevents the protruding end portion of the stick-type cosmetic preparation from being damaged by the cover.

It is preferable that the joint element have a structure that applies a spring force to the cover in its closing direction. This structure allows the cover to be closed automatically by means of the spring force when the stick-type cosmetic preparation is received into the main body. The structure does not require any additional operation for closing the cover, thereby further improving the convenience in use.

It is also preferable that the lifting mechanism is constructed to enable the stick-type cosmetic preparation and the sleeve to be accommodated into the tube of the main body in response to a movement of the movable unit to a position in the vicinity of the opening of the main body, and the joint element for attaching the cover to the opening is arranged on the same side as a position of the movable unit where the stick-type cosmetic preparation and the sleeve are received in the tube.

In this preferable structure, the movable unit is located in the vicinity of the opening when the stick-type cosmetic preparation is accommodated into the main body. Since the joint element for attaching the cover to the opening is arranged on the same side as the position of the movable unit, the cover can be closed by shifting the finger which has just been used to operate the movable unit to the position near the joint element by only a little distance. The user can thus close the cover by a substantially single operation.

In accordance with another preferable application of the present invention, the third case of stick-type cosmetic preparation further includes a cover attached to the opening of the main body to freely open and close the opening. The cover is linked with the movable unit and constructed to open and close the opening in connection with the movement of the movable unit.

In this structure, when a predetermined operating force is applied to the movable unit, the cover linked with the movable unit is opened and closed in response to the movement of the movable unit. No additional operation is thus required for opening or closing the cover.

The present invention is also directed to a cartridge of stick-type cosmetic preparation including a support member for supporting at least a stick-type cosmetic preparation and a joint member corresponding to the joint unit included in the lifting mechanism of the third case of stick-type cosmetic preparation described above. The cartridge is attached to and detached from a predetermined section including a main body of the third case of stick-type cosmetic preparation by linking and separating the joint member with and from the joint unit.

When the stick-type cosmetic preparation included in the third case of stick-type cosmetic preparation has been used up, the cartridge of stick-type cosmetic preparation is replaced by a new one and the main body is thus reusable with the new cartridge.

According to one aspect of the present invention, the cartridge further includes the support member and the sleeve included in the third case of stick-type cosmetic preparation having the third structure discussed above. The predetermined section including the main body which the cartridge of stick-type cosmetic preparation is attached to and detached from may be the main body included in the third case of stick-type cosmetic preparation of the third structure.

When the stick-type cosmetic preparation included in the third case of stick-type cosmetic preparation having the third structure has been used up, the cartridge of stick-type cosmetic preparation is replaced by a new one and the main body is thus reusable with the new cartridge.

It is preferable that the sleeve have a shape covering more than the whole length of the stick-type cosmetic preparation when a protruding end portion of the stick-type cosmetic preparation is received in the sleeve. In this structure, since the whole length of the stick-type cosmetic preparation is covered in the sleeve, the side face of the stick-type cosmetic preparation can be protected effectively from damages in storage of the cartridge or in the process of attaching the cartridge of stick-type cosmetic preparation.

According to one preferable application, the cartridge further includes a cap placed to cover a protruding end of the sleeve for protecting a protruding end portion of the stick-type cosmetic preparation received in the sleeve. The cap effectively prevents the protruding end portion of the stick-type cosmetic preparation from being damaged in storage of the cartridge.

In accordance with one aspect of the present invention, the cartridge further includes a protection member which is set inside the cap covering the protruding end of the sleeve for protecting the protruding end portion of the stick-type cosmetic preparation. The protection member relieves the damage which the protruding end portion of the stick-type cosmetic preparation may have when coming into contact with the inner wall of the cap.

It is preferable that the cap be composed of a transparent material. This enables the user to readily check the color of the stick-type cosmetic preparation included in the newly replaced cartridge.

It is also preferable that the cap be arranged to be removable by a force that is applied on a circumference of the sleeve toward the protruding end of the sleeve along a longitudinal axis of the sleeve and is less than a force required for releasing the engagement of the joint unit with the joint member. In the process of attaching the cartridge of stick-type cosmetic preparation, the cap is readily removed only by sliding the sleeve in the tube of the main body and bringing the cap into contact with the portion near to the opening of the tube. The user can thus replace the cartridge under a favorable sanitary condition without exposing the protruding end portion of the stick-type cosmetic preparation to the exterior.

In accordance with one preferable application of the present invention, the cartridge of stick-type cosmetic preparation further includes a support cover for covering a bottom portion of the sleeve to keep the connecting protrusion linked with the support member in a state of engaging with the engagement slot of the guide groove. The cartridge can accordingly be stored in the state that the connecting protrusion is fitted in the engagement slot of the guide groove.

It is preferable that the support cover include a first engagement slot, which the connecting protrusion passing through the guide groove is fitted in, and a second engagement slot, which the engagement element on the sleeve is fitted in. The first engagement slot and the second engagement slot are formed in parallel to each other along a longitudinal axis of the sleeve and arranged to have a positional relationship corresponding to a positional relationship between the connecting protrusion set in the engagement slot of the guide groove and the engagement element on the sleeve. The support cover can be removed by pulling the sleeve up, while the connecting protrusion is fitted in the engagement slot of the guide groove.

The present invention is further directed to a fourth case of stick-type cosmetic preparation including a support member for supporting a stick-type cosmetic preparation, a sleeve for receiving at least a protruding end portion of the stick-type cosmetic preparation therein, a main body having an opening on one end thereof, and a casing for receiving the main body therein. The main body has a tube for receiving the sleeve and the support member with the stick-type cosmetic preparation therein. The case further includes: a lifting mechanism comprising a movable unit moving in response to a predetermined operating force applied externally, an interlocking unit for transmitting the movement of the movable unit to the support member and the sleeve, and a transmitting unit for making the support member and the sleeve slide up and down in the tube along a longitudinal axis of the main body in response to the movement of the movable unit transmitted by the interlocking unit and for enabling a protruding end portion of the stick-type cosmetic preparation to be protruded from the sleeve and the opening of the main body; and an attachment mechanism for enabling the main body including the stick-type cosmetic preparation and the lifting mechanism to be attached to and detached from the casing via a predetermined attachment unit.

In the fourth case of stick-type cosmetic preparation thus constructed, the movable unit is shifted by a predetermined operating force applied thereto. The interlocking unit transmits the movement of the movable unit to the support member for supporting the stick-type cosmetic preparation and the sleeve, in which at least the protruding end portion of the stick-type cosmetic preparation is accommodated. In response to the movement of the movable unit thus transmitted, the support member and the sleeve slide up and down in the tube of the main body. The protruding end portion of the stick-type cosmetic preparation is thereby protruded from the sleeve and the opening of the main body. The main body including the lifting mechanism for realizing the protrusion of the stick-type cosmetic preparation can be attached to and detached from the casing.

In the fourth case of stick-type cosmetic preparation according to the present invention, the protruding end portion of the stick-type cosmetic preparation is protruded from the sleeve and the opening of the main body by simply applying a predetermined operating force to the movable unit. The stick-type cosmetic preparation can thus be prepared for application by a single operation. The main body including the constituents of the lifting mechanism for realizing the protrusion of the stick-type cosmetic preparation can be attached to and detached from the casing. When the stick-type cosmetic preparation received in the main body has been used up, the main body itself is replaced by a new one and the casing is thus reusable with the new main body. In the fourth case having the above structure, the constituents of the lifting mechanism are included in the main body, so that the mechanism relating to the attachment and detachment can be simplified. At least the protruding end portion of the stick-type cosmetic preparation is received in the sleeve, which is further accommodated in the main body. Even when an impact is applied to the case of stick-type cosmetic preparation in carriage, the protruding end portion of the stick-type cosmetic preparation can accordingly be protected from damages in the case.

OTHER APPLICATIONS OF THE INVENTION

The present invention may be realized by other applications as given below. For example, instead of the shape covering over the whole length of the stick-type cosmetic preparation, the sleeve may have any other desirable shape for receiving at least the fragile protruding end portion of the stick-type cosmetic preparation. The sleeve may have any shape that receives the stick-type cosmetic preparation and allows a sliding movement thereof in the sleeve. For example, the sleeve may be formed in a shape of hollow square column, instead of the cylindrical shape.

The predetermined operation of the movable unit may be a sliding operation along the longitudinal axis of the main body. In this case, the user can readily make the stick-type cosmetic preparation accommodated into and protruded from the main body by sliding up and down the movable unit with a thumb while the main body is held with one hand.

In the third case of stick-type cosmetic preparation having the third structure discussed above, the connecting protrusion connecting with the support member and having a predetermined resilience may be replaced by another connecting protrusion connecting with the belt and having a predetermined resilience. The connecting protrusion arranged on the belt for linking the support member with the predetermined position of the belt exerts the same effects as those of the connecting protrusion arranged on the support member.

A predetermined lubricant may be applied to the belt, which is connected with the movable unit and arranged at a predetermined position in the main body to be freely movable in a sliding manner for directly transmitting a moving distance of the movable unit, in order to regulate the frictional force generated between the belt and the predetermined position in the main body. Application of the lubricant controls the magnitude of the force required for shifting the movable unit. The resistance in the sliding movement of the belt may be set equal to a predetermined amount. This enables the stick-type cosmetic preparation to be held at an arbitrary position in the course of protrusion of the stick-type cosmetic preparation. The user can then apply the stick-type cosmetic preparation onto the lips (in other words, the user can press the stick-type cosmetic preparation against the lips) at the arbitrary position.

BEST MODES FOR EMBODYING THE INVENTION

The following describes preferable modes for embodying the present invention. In the embodiments discussed below, the stick-type cosmetic preparation is a lipstick and the case of the stick-type cosmetic preparation embodying the present invention is a lipstick case.

Figures 1A, 1B, 1C, 1D:
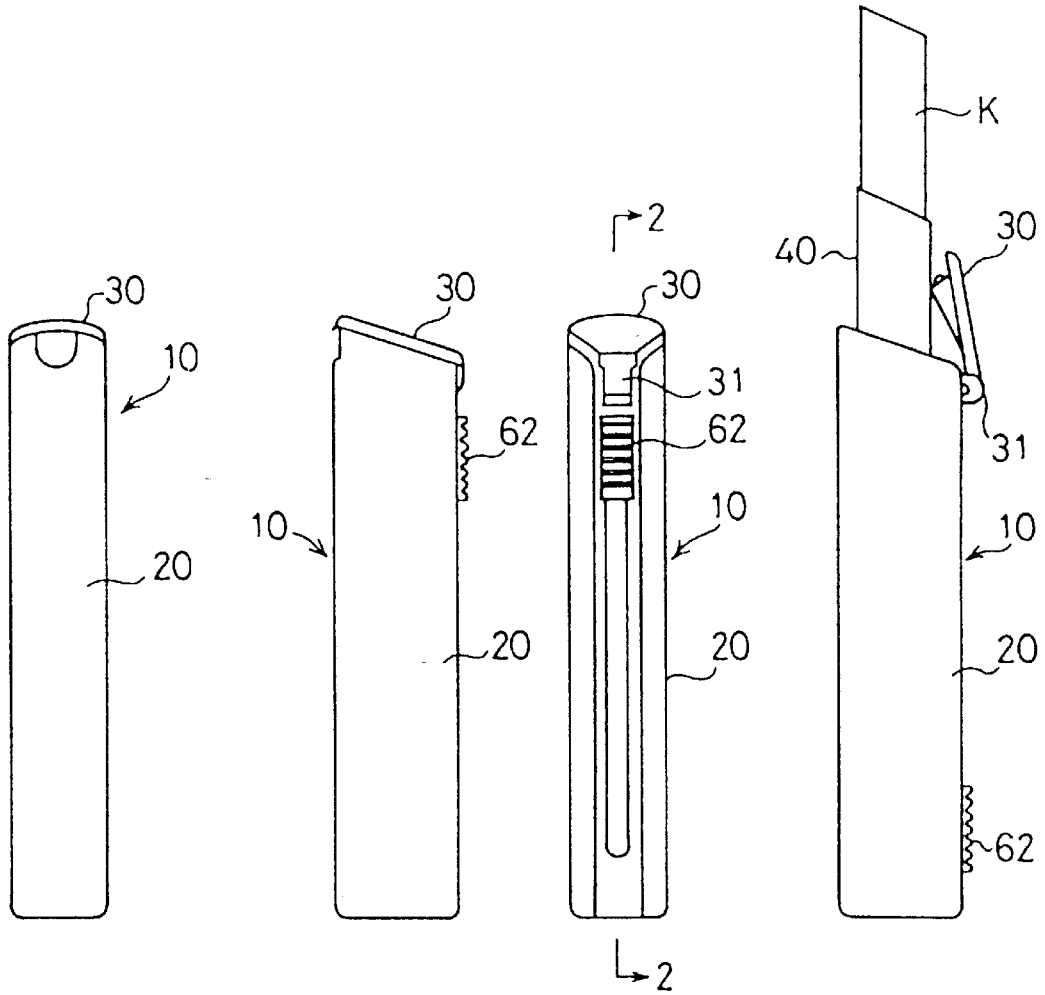
FIGS. 1(A)–1(D) show a lipstick case 10 as a first embodiment according to the present invention.
Figure 2:
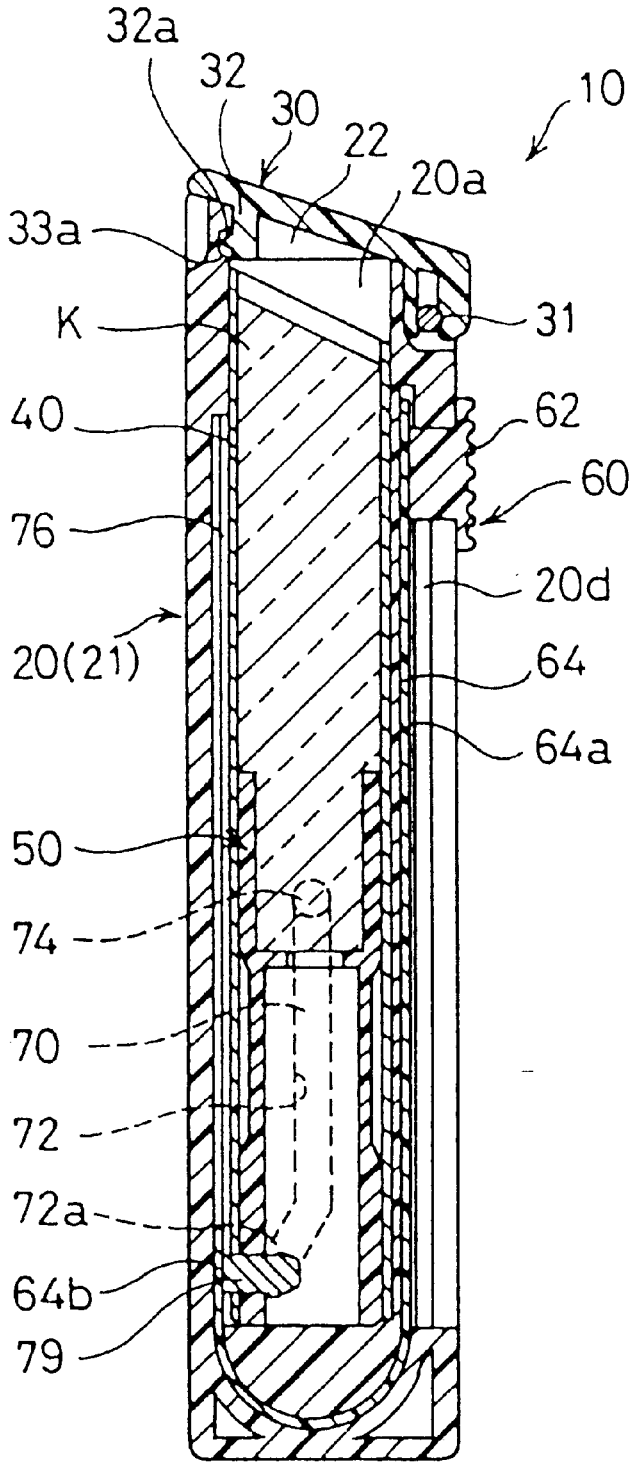
FIG. 2 is an enlarged cross sectional view, taken on the line 2—2 of FIG. 1(C)
Figure 3:
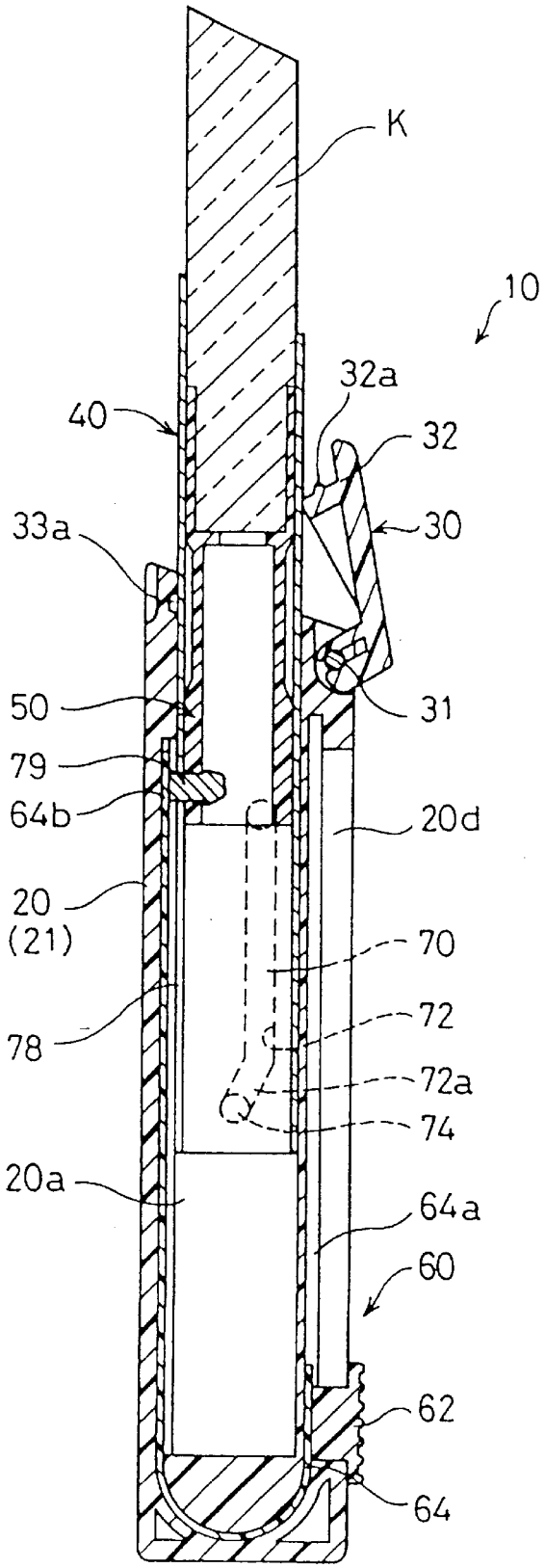
FIG. 3 is a cross sectional view showing the state of protruding the lipstick K from the lipstick case 10 of FIG. 2.
Figure 4:
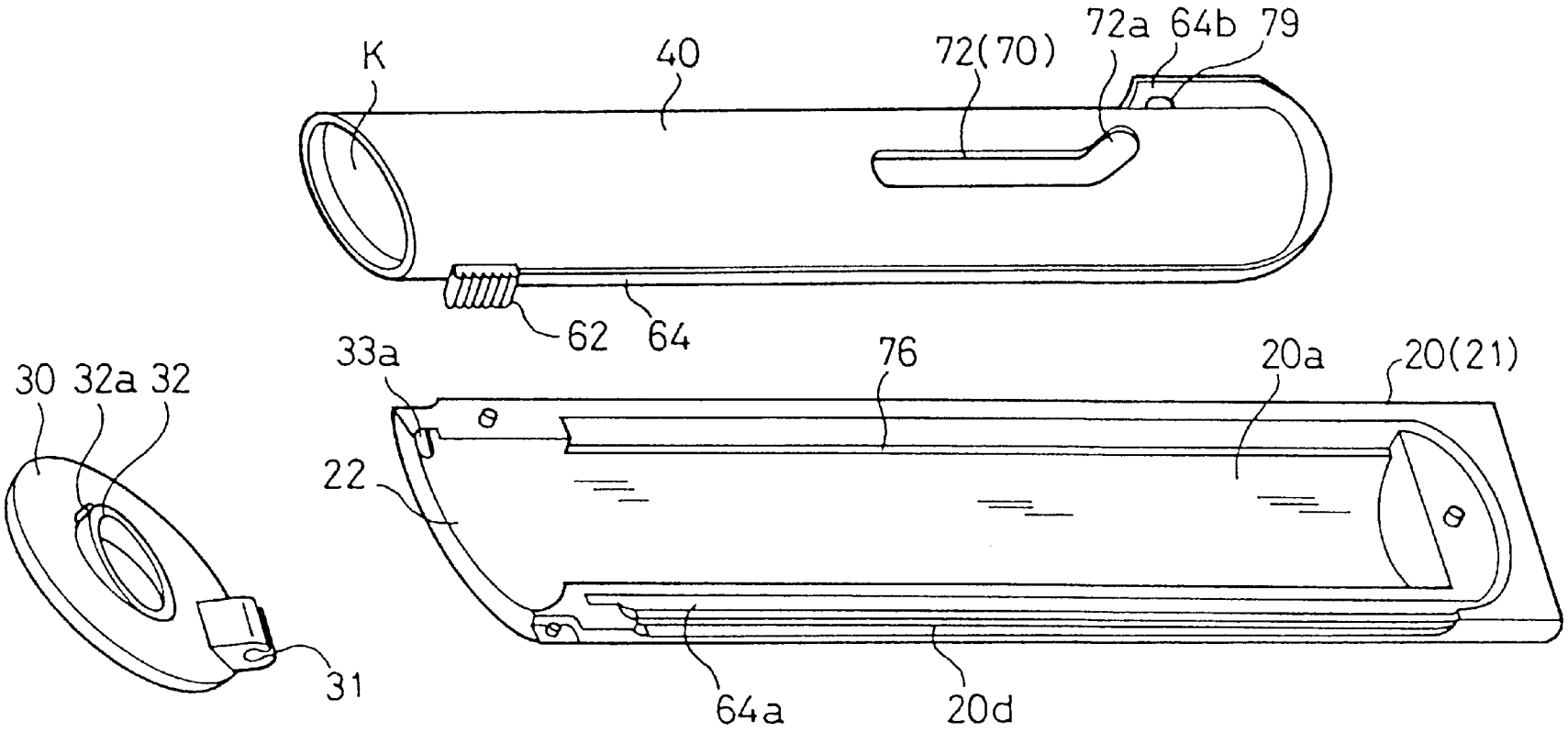
FIG. 4 is a decomposed perspective view of a part of the lipstick case 10.

FIG. 1 shows the appearance of a lipstick case 10 for accommodating a lipstick K therein to enable the lipstick K to be freely protrudable from the lipstick case 10. FIGS. 1(A), 1(B), and 1(C) are respectively a front view, a side view, and a rear view of the lipstick case 10, whereas FIG. 1(D) is a side view in which the lipstick K is protruded from the lipstick case 10. FIG. 2 is an enlarged cross sectional view, taken on the line 2—2 of FIG. 1(C); FIG. 3 is a cross sectional view showing the state of protruding the lipstick K from the lipstick case 10 of FIG. 2; and FIG. 4 is a decomposed perspective view of a part of the lipstick case 10.

Referring to FIGS. 1 through 4, the lipstick case 10 includes a cylindrical main body 20 having a bottomed tube 20*a*, a cover 30, a metal sleeve 40 slidably accommodated in the bottomed tube 20*a*, a support member 50 arranged inside the sleeve 40 for supporting the lipstick K, and a lifting mechanism 60.

The cylindrical main body 20 is manufactured by joining a pair of substantially symmetrical split halves 21 (only one split half shown in FIG. 4) with each other by ultrasonic welding. The split halves 21 of the main body 20 may alternatively be joined with each other via an adhesive or by any other suitable technique. The bottomed tube 20*a* of the main body 20 has an opening 22 on an inclined upper end thereof.

The cover 30 is composed of a hard resin and used to open and close the opening 22. The cover 30 is fixed to the main body 20 via a hinge 31 disposed on the lower side of the inclined opening 22. The hinge 31 is structured to hold the cover 30 at a predetermined angle (approximately 75 degrees with respect to the horizontal axis of the lipstick case 10) that enables a free end of the cover 30 to come into contact with an outer side wall of the sleeve 40, while the cover 30 is in open position and the sleeve 40 is slid out as shown in FIG. 1(D). The hinge 31 also enables the cover 30 to be held at a desired angle when the user applies a force to open the cover 30. An inclined ring projection 32, which is extended from the bottom face of the cover 30, is fitted in the inclined opening 22. The inclined ring projection 32 of the cover 30 is provided with an engagement pawl 32*a*, which is received in an engagement recess 33*a* formed inside the opening 22 of the main body 20. Engagement of the engagement pawl 32*a* with the engagement recess 33*a* and its release ensure a moderate touch when the cover 30 is closed and opened.

The sleeve 40 is accommodated in the tube 20*a* to be slidable along the longitudinal axis of the tube 20*a* and rotatable to a little extent. The sleeve 40 has sufficient length to receive the whole length of the lipstick K. The support member 50 is disposed inside the sleeve 40 to be slidable along the longitudinal axis of the sleeve 40 and to support the lower portion of the lipstick K.

The lifting mechanism 60 for lifting up and down the sleeve 40, the lipstick K, and the support member 50 includes an operating member 62, a belt 64, and a cam mechanism 70.

The user operates the operating member 62 with a finger to enable the lipstick K to be protruded from and accommodated into the lipstick case 10. The operating member 62 is fitted in a control slot 20*d* to be slidable between an upper-most position and a lower-most position along the control slot 20*d*. The control slot 20*d* is formed along the longitudinal axis on the outer surface of the main body 20. The operating member 62 protrudes from the outer surface of the main body 20 to ease its operation.

The operating member 62 is fixed to a first end of the belt 64, which is composed of a flexible resilient material. The width of the belt 64 is held by a belt sliding groove 64*a* formed in the main body 20, so that the belt 64 is slidingly movable in the belt sliding groove 64*a*. The belt sliding groove 64*a* is formed as a U-shaped, relatively deep slit, which starts from one end in the vicinity of the operating member 62 set in its upper-most position, is bent gradually on the lower end portion of the main body 20, and extends to the other end substantially opposite to the operating member 62 set in its upper-most position. The belt 64 is accordingly guided by the belt sliding groove 64*a* in a sliding manner toward the other end of the belt sliding groove 64*a*.

Figure 5A:
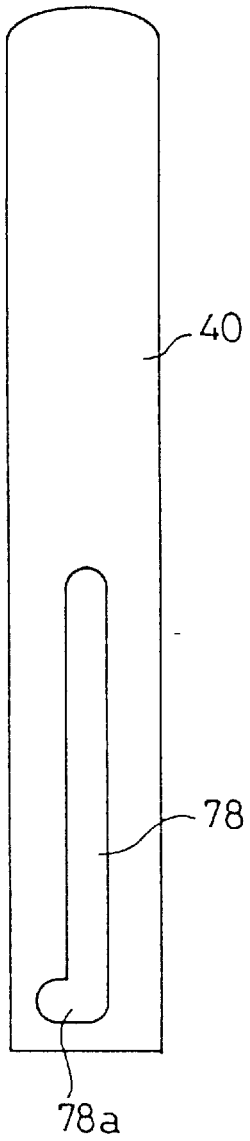
FIGS. 5(A)–5(C) show the appearance and cross section of the sleeve 40.
Figure 5B:
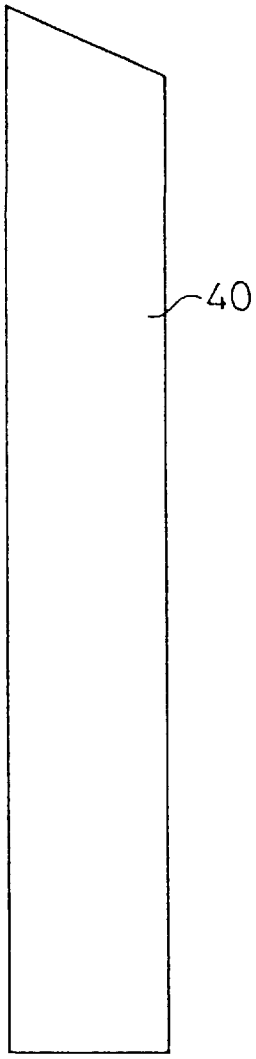
Figure 5C:
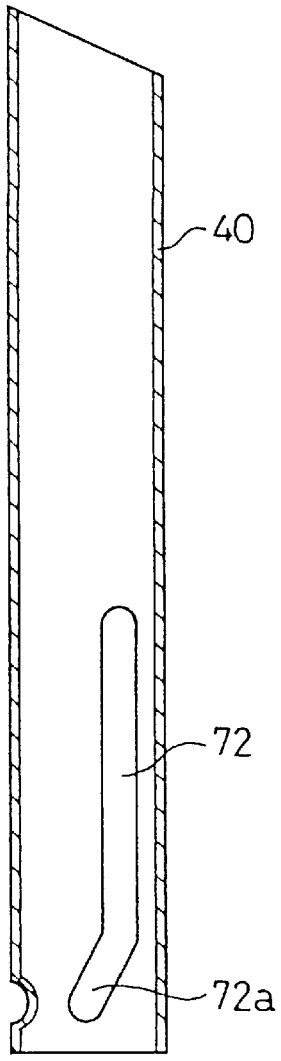
Figure 6:
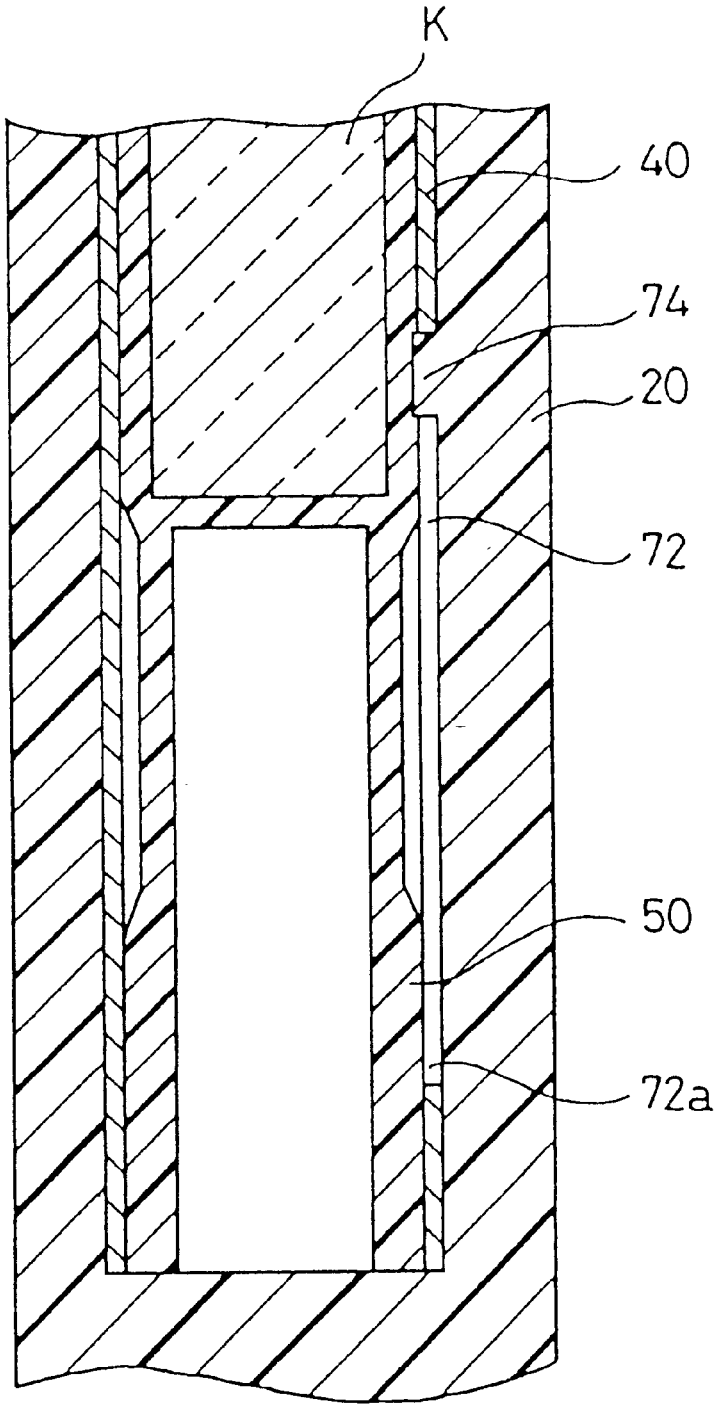
FIG. 6 is a cross sectional view showing a central portion of the sleeve 40.

FIG. 5 shows the appearance and cross section of the sleeve 40; and FIG. 6 is across sectional view showing a central portion of the sleeve 40. The cam mechanism 70 includes a cam groove 72 formed along the longitudinal axis in the side wall of the sleeve 40, a first sliding piece 74 (see FIG. 6) projected from the inner wall of the tube 20*a* and thrust into the cam groove 72, a support slot 76 (see FIG. 2) formed along the longitudinal axis of the tube 20*a* to connect the tube 20*a* with the belt sliding groove 64*a*, a guide groove 78 (see FIG. 3) formed along the longitudinal axis of the sleeve 40 to be arranged opposite to the cam groove 72, and a connection pin 79 (see FIG. 2) for connecting a second end 64*b* of the belt 64 with the support member 50.

Figure 7:
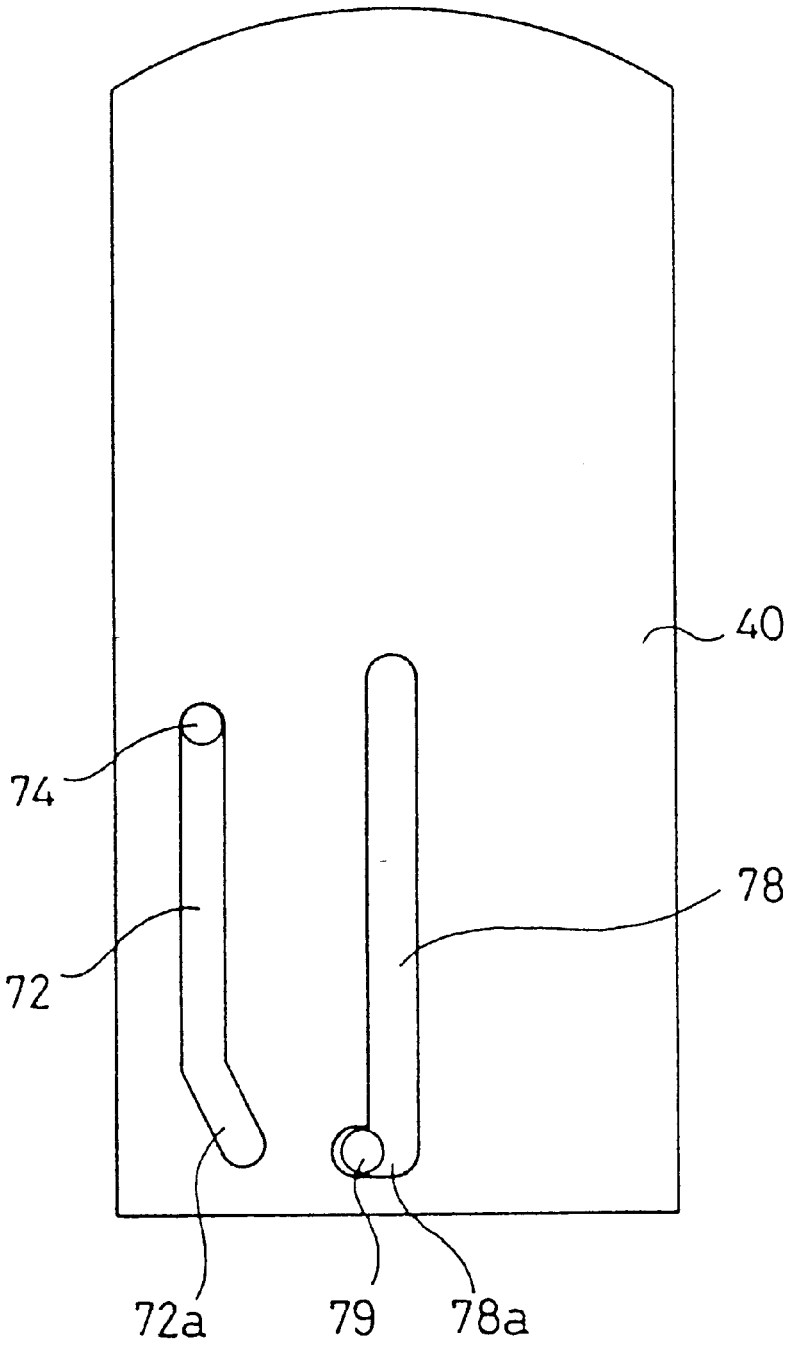
FIG. 7 is a development view of the sleeve 40 with the cam mechanism 70.
Figure 8:
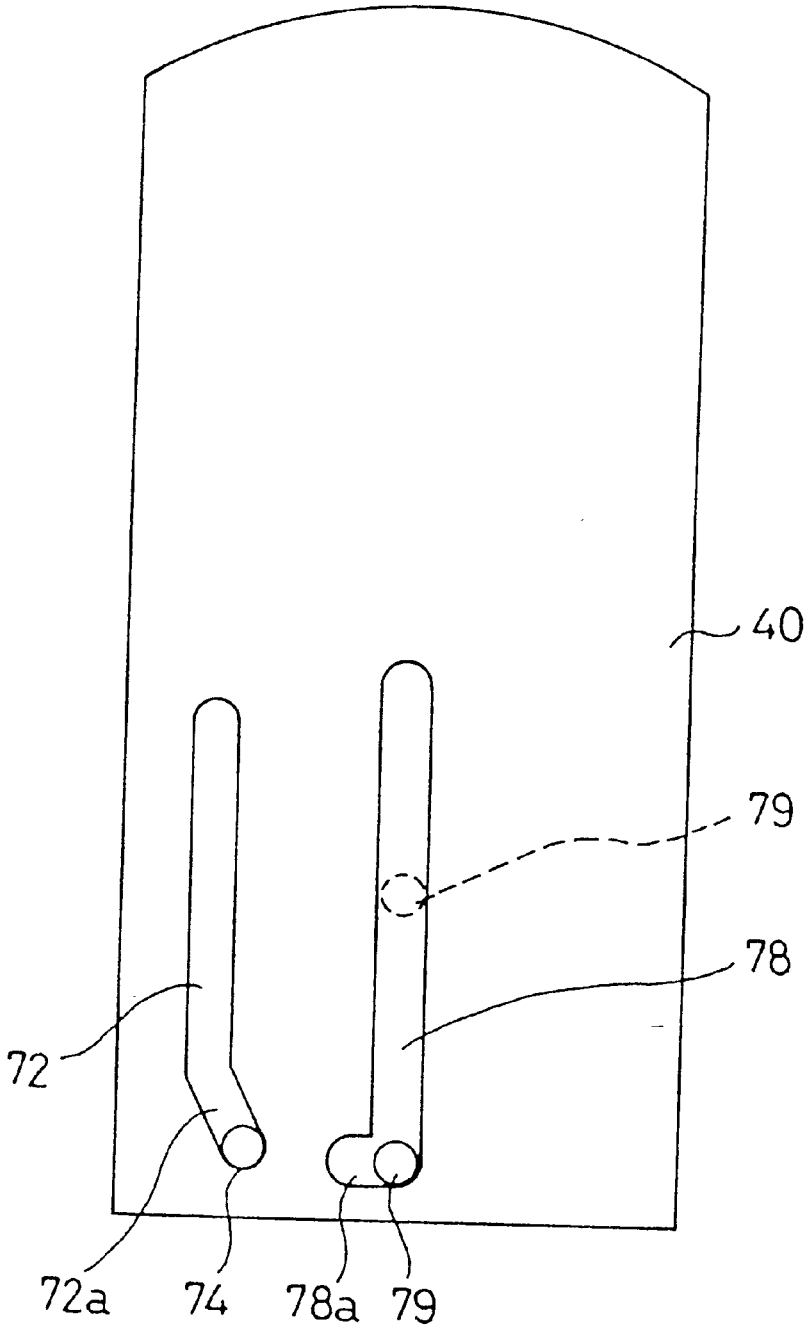
FIG. 8 is a development view of the sleeve 40 with the cam mechanism 70 operated to make the lipstick K protruded from the state of FIG. 7.
Figure 9:
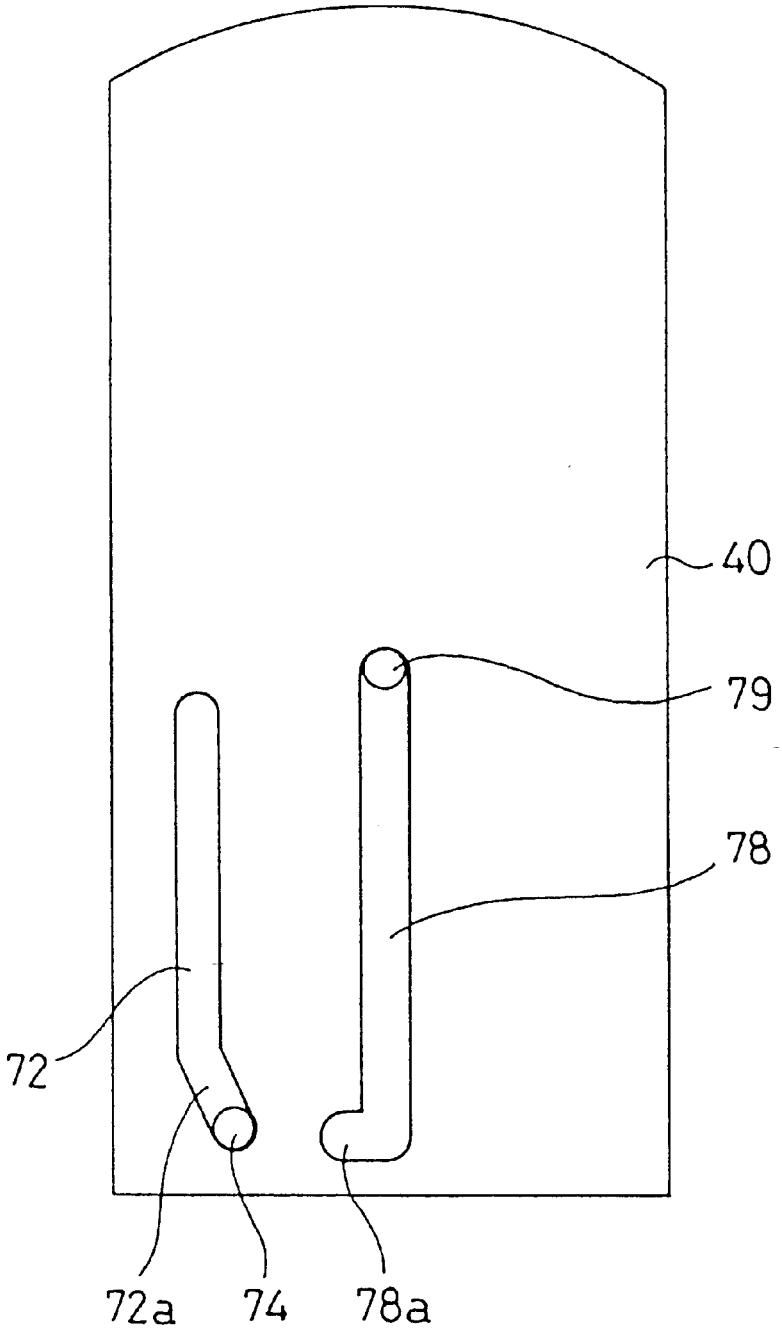
FIG. 9 is a development view of the sleeve 40 with the cam mechanism 70 operated to make the lipstick K further protruded from the state of FIG. 8.

FIGS. 7 through 9 are development views of the cylindrical sleeve 40. When the sleeve 40 is thoroughly accommodated in the tube 20*a* of the main body 20, the first sliding piece 74 comes into contact with the upper end of the cam groove 72 (corresponding to the state of FIG. 7) When the upper end of the sleeve 40 is protruded a little from the main body 20, on the other hand, the first sliding piece 74 comes into contact with the lower end of the cam groove 72 (corresponding to the state of FIG. 8). The lower end of the cam groove 72 is bent in one direction to form a cam slot 72*a*, which rotates the sleeve 40 to a little extent immediately before the sleeve 40 comes into contact with the top dead center.

Referring back to FIG. 2, the support slot 76 has a length, which is identical with the length of the control slot 20*d* and corresponds to a stroke of the lipstick K and the support member 50. The guide groove 78 of the sleeve 40 shown in FIG. 7 is formed to face the support slot 76. The lower end of the guide groove 78 is bent at a substantially right angle in the direction opposite to the rotation of the sleeve 40 to form a horizontal slot 78*a* (see FIG. 5(A)). The connection pin 79 for connecting the second end 64*b* of the belt 64 with the support member 50 passes through the support slot 76 and the guide groove 78.

Figure 10:
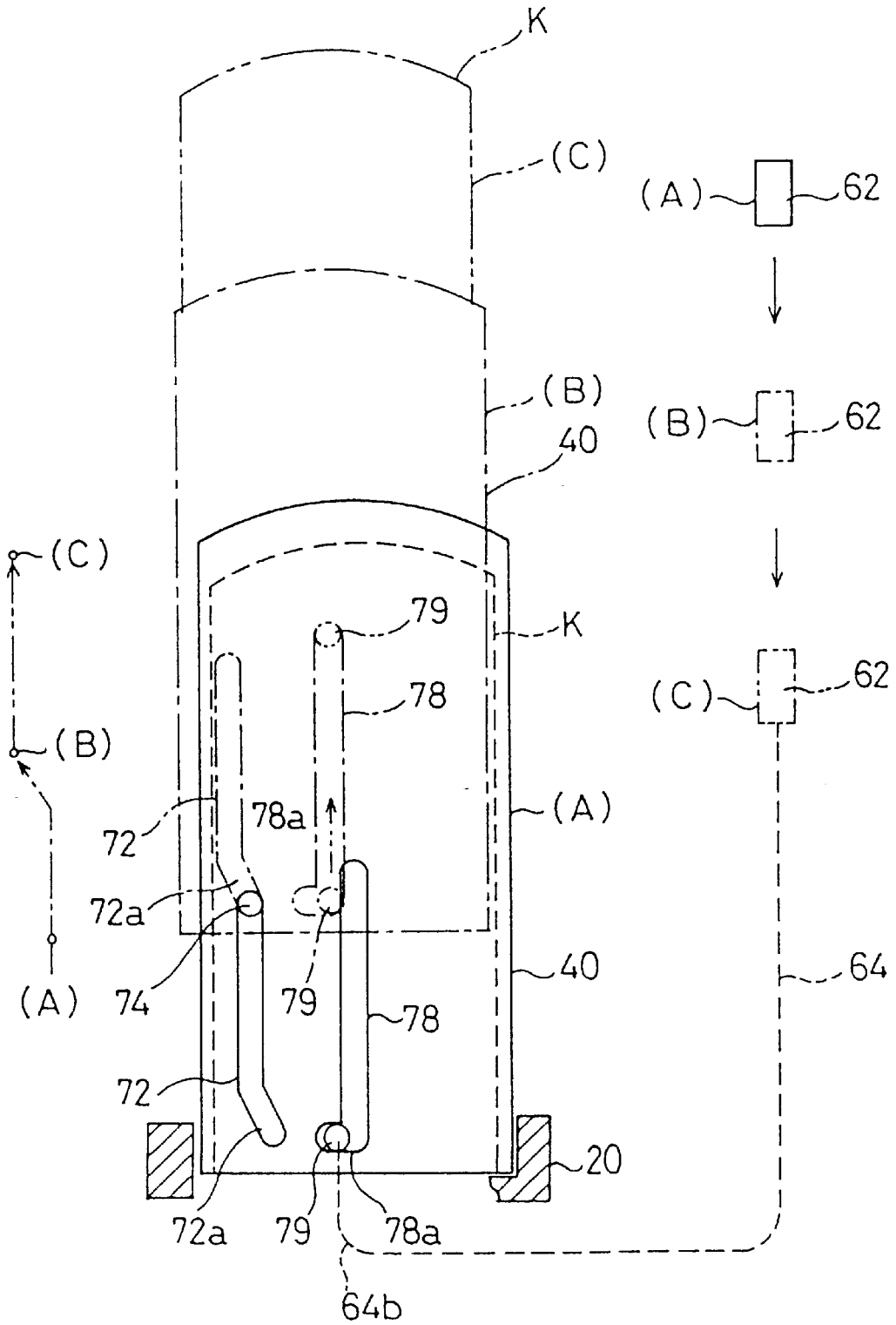
FIG. 10 shows a series of sliding operations of the cam mechanism 70 shown in FIGS. 7 through 9.

The lipstick K is protruded from and accommodated into the lipstick case 10 in the manner described below. FIG. 10 shows a series of sliding operations of the cam mechanism 70 shown in FIGS. 7 through 9. In the state of FIG. 2, the opening 22 of the tube 20*a* is closed with the cover 30, and the lipstick K is thoroughly accommodated in the main body 20. Under such conditions, the operating member 62 is located at its upper-most position, that is, the upper end of the control slot 20*d*, whereas the first sliding piece 74 comes into contact with the upper end of the cam groove 72 formed in the sleeve 40 and the connection pin 79 is fitted in the horizontal slot 78*a* of the guide groove 78 (corresponding to the state of FIGS. 7 and 10(A)).

When the user slides down the operating member 62 from its upper-most position, the belt 64, whose first end is fixed to the operating member 62, slidingly moves in connection with the movement of the operating member 62. As discussed previously, the belt 64 is guided by the U-shaped belt sliding groove 64*a*, so that the sliding movement of the belt 64 lifts up the second end 64*b* of the belt 64 and thereby up the connection pin 79 fixed to the second end 64*b*. Since the connection pin 79 is fitted in the horizontal slot 78*a* of the guide groove 78, the sleeve 40 moves up with the support member 50. A further upward movement of the sleeve 40 after the upper end of the sleeve 40 comes into contact with the lower surface of the cover 30 enables the cover 30 to pivot on the hinge 31 and be press-opened.

When the user further slides down the operating member 62, the first sliding piece 74 moves down to the cam slot 72*a* arranged on the lower end of the cam groove 72. Since the lower end of the cam groove 72 is bent to form the cam slot 72*a* as discussed above, the sleeve 40 is rotated a little. This slight rotation of the sleeve 40 releases the connection pin 79 from the engagement with the horizontal slot 78*a* of the guide groove 78 (corresponding to the state of FIGS. 8 and 10(B)).

The connection pin 79 released from the engagement goes up in the guide groove 78. Under such conditions, the sliding force of the operating member 62 is not transmitted to the sleeve 40 via the belt 64 so as to stop the sleeve 40 at the position, but is transmitted to the support member 50 via the connection pin 79 so as to move up the support member 50. The lipstick K fixed to the support member 50 accordingly moves up and is protruded from the sleeve 40 and further from the opening 22 of the main body 20 (corresponding to the state of FIGS. 3, 9, and 10(C)). In this state, the user can use the lipstick K.

When the user slides up the operating member 62 from the lower-most position in which the lipstick K is protruded from the main body 20, on the contrary, the lipstick K fixed to the support member 50 moves down and is accommodated into the sleeve 40, which is subsequently accommodated into the main body 20 thoroughly, in reverse sequence. The user then presses down the cover 30 to close the opening 22 of the main body 20 and return the lipstick case 10 to the initial state.

The structure of the first embodiment is expected to have the effects given below.

(1) A simple sliding operation of the operating member 62 opens the cover 30 and enables the lipstick K to be protruded from the main body 20 and ready for use. No additional operation is required to open the cover 30.

(2) A sliding operation of the operating member 62 moves up the sleeve 40 and press-opens the cover 30 by means of the upper end portion of the sleeve 40. The lipstick K supported by the support member 50 is then protruded from the sleeve 40. This structure allows not the lipstick K but the upper end portion of the sleeve 40 to come into contact with and press-open the cover 30, so that the lipstick K is not damaged by the contact.

(3) The cover 30 comes into contact with the side face of the sleeve 40 while being in open position. This effectively protects the lipstick K from damages.

(4) The sleeve 40 has sufficient length to receive the whole length of the lipstick K, thereby protecting the lipstick K while the lipstick K is being protruded from the main body 20.

(5) The cover 30 which is composed of a resilient material, such as a hard resin, is not easily deformed in high temperatures (for example, in summer) and ensures a tight closing and high sealing property.

(6) The cover 30 is attached to the opening 22 of the main body 20 via the hinge 31. This structure does not undesirably make the main body 20 bulky but easily gives preferable design effects.

(7) The engagement pawl 32*a* of the cover 30 is received in and released from the engagement recess 33*a* formed in the main body 20, when the cover 30 is in closed position and open position. This engagement and release gives a moderate touch when the cover 30 is closed and opened.

(8) The hinge 31 attached to the cover 30 is not provided with a spring or a like element. The cover 30 can accordingly be opened with a small force. This spring-free structure prevents the spring force from being applied as a stress to the belt 64 via the sleeve 40 while the cover 30 is in open position. This does not wear the belt 64 nor deteriorate its durability.

(9) The sleeve 40 is interposed between the main body 20 and the lipstick K. The diameters of the lipstick K, the sleeve 40, and the main body 20 gradually increase in this order. This lessens the difference in diameter and gives preferable design effects.

(10) The operating member 62 and the hinge 31, which protrude from the main body 20, are arranged on the same side of the main body 20. The other side of the main body 20 accordingly does not have any protrusion but has a smooth surface. This structure improves the design effects of the main body 20.

(11) After the cover 30 is press-opened by the upper end portion of the sleeve 40, the hinge 31 functions to hold the cover 30 at the position in contact with the side wall of the sleeve 40 as shown in FIG. 1(D). This prevents the cover 30 from being excessively opened and interfering with smooth application of the lipstick K.

(12) The user slides down operating member 62 to enable the lipstick K to be protruded from the main body 20. This action is quite reasonable and ensures good operating ability.

(13) The opening 22 of the main body 20 is inclined as discussed above. When the upper end portion of the sleeve 40 comes into contact with and press-opens the cover 30, this inclined structure makes the required opening angle of the cover 30 sufficiently small, requires a relatively little force to open the cover 30, and decreases a stress applied to the belt 64 via the sleeve 40.

The above embodiment is only illustrative and not restrictive in any sense. There may be many modifications, changes, and alterations without departing from the scope and spirit of the main characteristics of the present invention. Some possible examples of modification are given below.

(1) In the above embodiment, the cover 30 is press-opened by the upper end portion of the sleeve 40. Another possible structure does not include the cover 30 but forms one end of the belt as a shutter, which opens and closes the opening 22. The latter structure does not require the cover formed as a separate member, thereby reducing the number of parts.

(2) The hinge 31 may have an additional element for applying a spring force to the cover 30 in the closing direction. This does not require the closing operation of the cover 30 and further improves the convenience of use. In this case, however, it is desirable that the belt is composed of a resilient material which is not easily damaged by the stress of a spring force and has an excellent durability.

(3) In accordance with one possible structure, the sleeve 40 has an engagement element on one end thereof, whereas the cover 30 has a mated engagement element. The cover 30 is closed and opened via the engagement of the both engagement elements in connection with the downward movement and the upward movement of the sleeve 40.

(4) In the above embodiment, the operating member 62 is arranged on the same side as the hinge 31 of the cover 30. The operating member 62 may, however, be arranged opposite to the hinge 31, at a position that ensures a good operating ability with a finger, for example, at an angle of approximately 45 degrees with respect to the hinge 31, or at any other desirable position on the main body 20.

(5) The sleeve 40 is made of a metal in the above embodiment. As long as the material is suitable for press-opening the cover 30, however, another material, such as a hard resin, may be used for the sleeve 40.

(6) In the above embodiment, the cam mechanism 70 includes the first sliding piece 74 formed on the main body 20 and the cam groove 72 formed in the sleeve 40. Similar effects, however, are exerted in the reverse arrangement where the sleeve 40 has a projection and the main body 20 has a cam groove. The cam mechanism is not restricted to the structure of the first sliding piece 74 and the cam groove 72. As long as the structure can guide the movement of the sleeve 40, the first sliding piece and the cam groove may have any other shape and structure, for example, one for receiving a threaded engagement piece.

Another lipstick case 110 is described as a second embodiment according to the present invention. The lipstick case 110 of the second embodiment has an attachment mechanism 180 as well as a lifting mechanism 160 (see FIG. 12), which is similar to the lifting mechanism 60 of the lipstick case 10 described above as the first embodiment. The attachment mechanism 180 enables a predetermined section including a lipstick K to be attachable to and detachable from a main body 120.

Figures 11A, 11B, 11C, 11D:
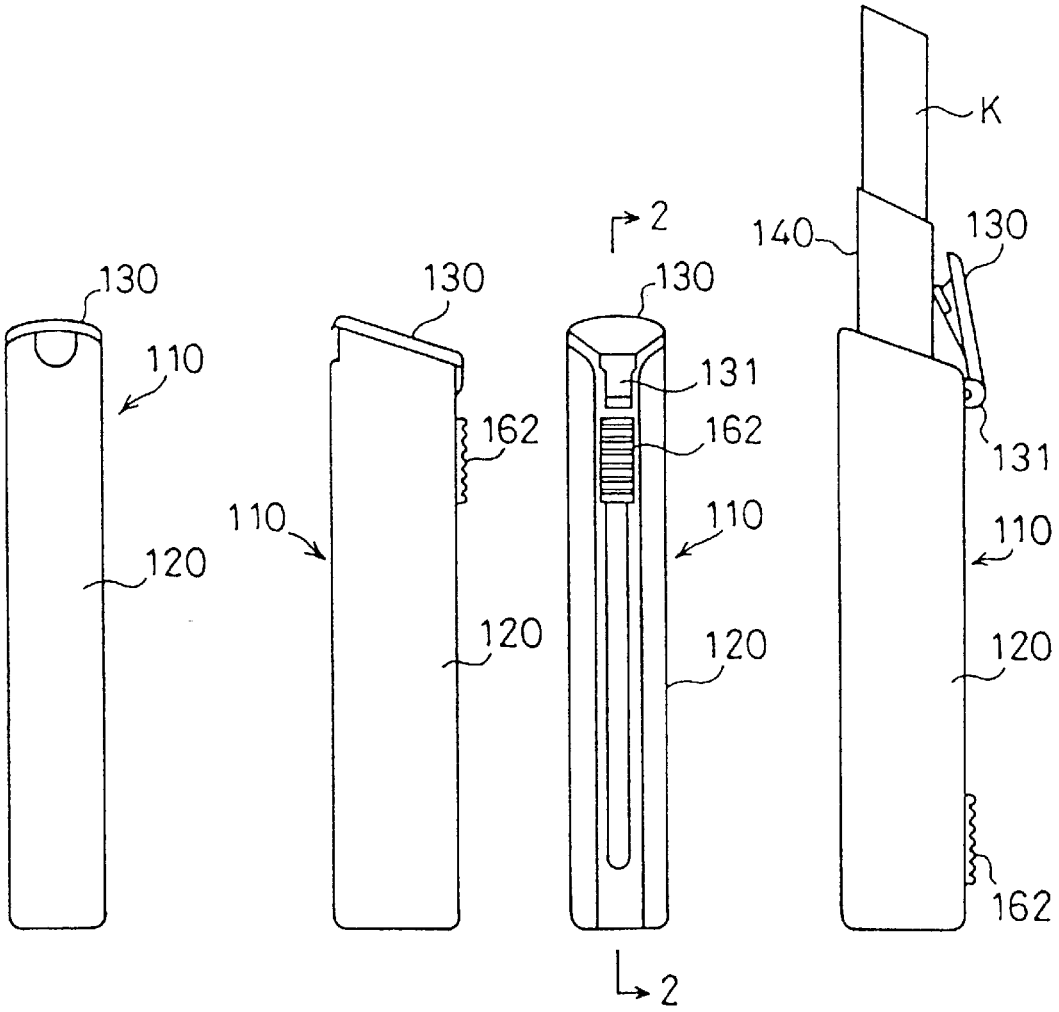
FIGS. 11(A)–11(D) show the appearance of another lipstick case 110 as a second embodiment according to the present invention.
Figure 12:
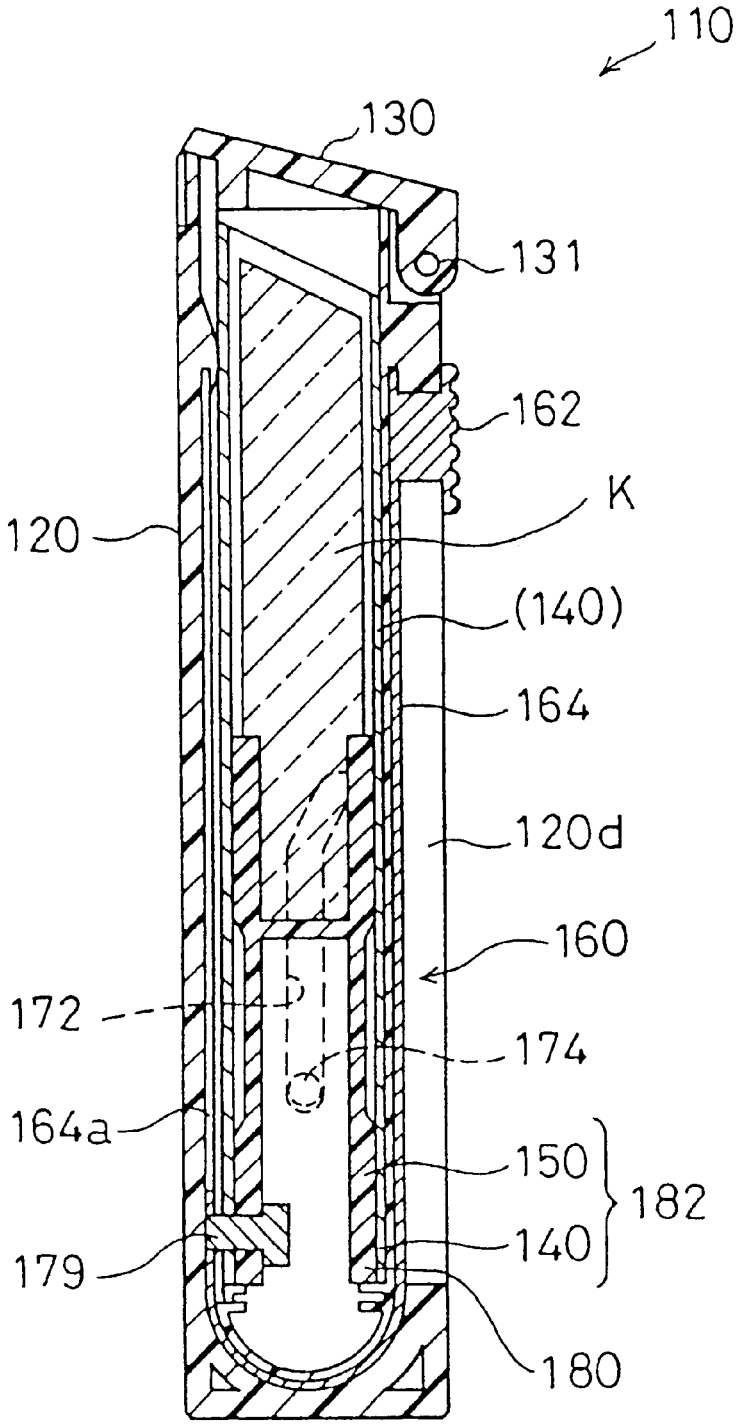
FIG. 12 is an enlarged cross sectional view of the lipstick case 110 with the lipstick K received therein, taken on the line 2—2 of FIG. 11(C)
Figure 13:
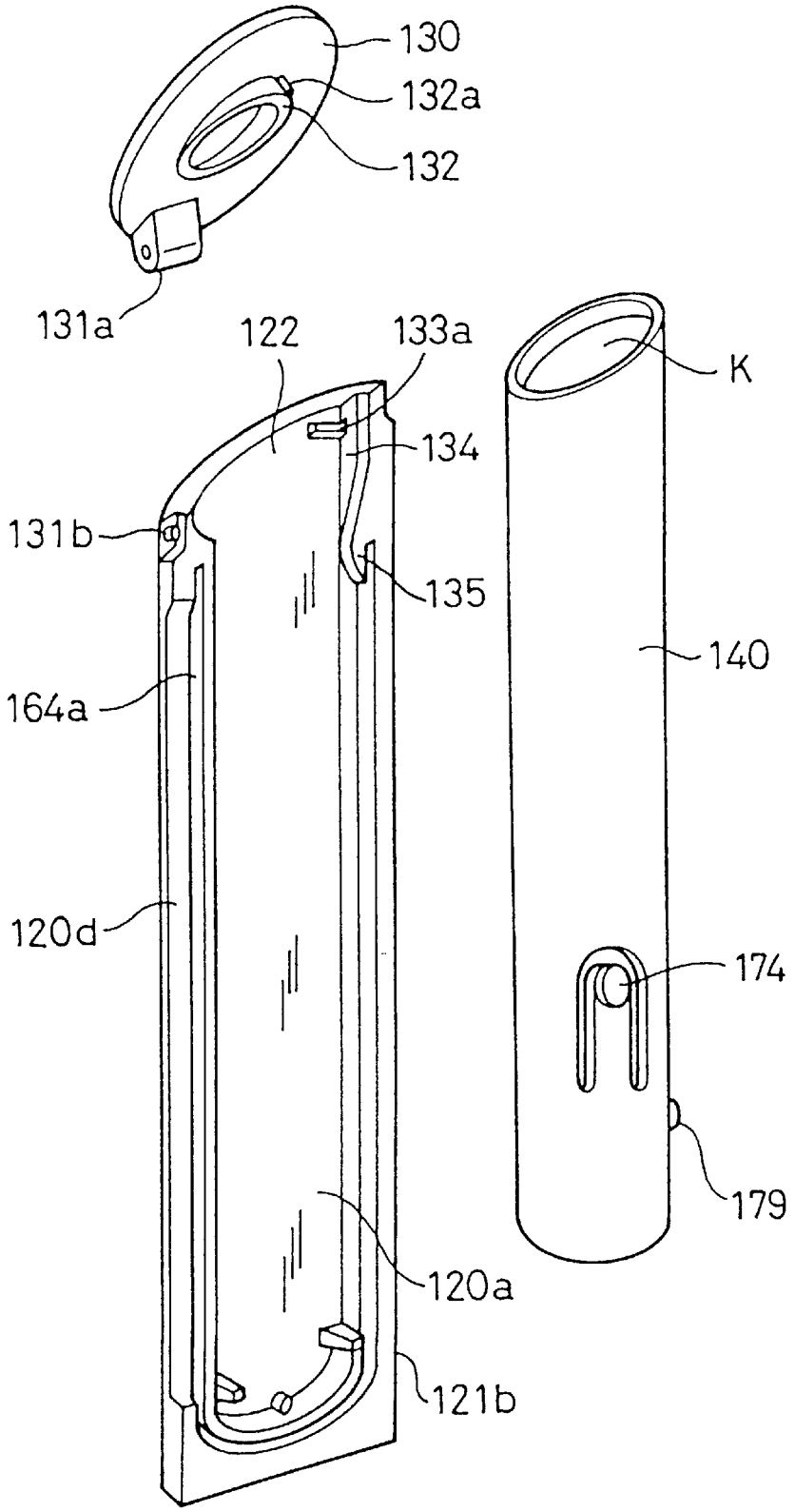
FIG. 13 is a partially decomposed perspective view showing the constituents of the lipstick case 110.
Figure 14:
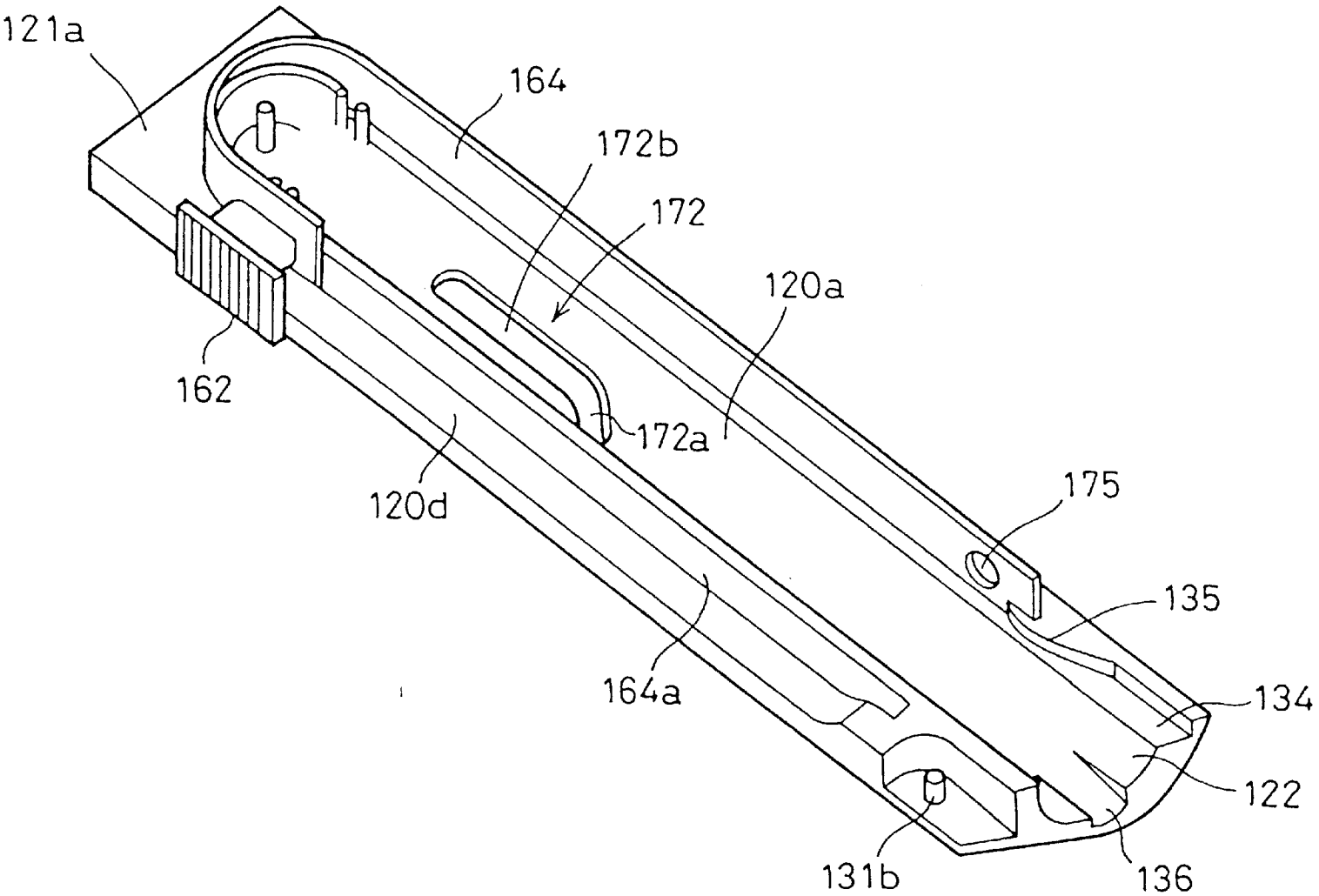
FIG. 14 is a perspective view showing the first split half 121*a* of the lipstick case 110.

FIG. 11 shows the appearance of the lipstick case 110 of the second embodiment. FIGS. 11(A), 11(B), and 11(C) are respectively a front view, a side view, and a rear view of the lipstick case 110, whereas FIG. 11(D) is a side view in which the lipstick K is protruded from the lipstick case 110. FIG. 12 is an enlarged cross sectional view, taken on the line 2—2 of FIG. 11(C); FIG. 13 is a decomposed perspective view showing a part of the constituents of the lipstick case 110; and FIG. 14 is a perspective view showing the residual constituents of the lipstick case 110. The following describes the structure of the lipstick case 110 based on the drawings of FIGS. 11 through 14, the structure and operation for realizing protrusion of the lipstick K from the lipstick case 110, and the structure and operation for realizing attachment and detachment of the predetermined section including the lipstick K.

Referring to FIGS. 11 through 14, the lipstick case 110 includes a cylindrical main body 120 having a bottomed tube 120*a*, a cover 130 attached to the main body 120, a sleeve 140 slidably accommodated in the bottomed tube 120*a*, a support member 150 arranged inside the sleeve 140 for supporting the lipstick K, and a lifting mechanism 160.

The main body 120 includes the tube 120*a*, which extends along the longitudinal axis thereof and is manufactured by joining a pair of substantially symmetrical split halves 121*a* and 121*b* with each other by ultrasonic welding. The second split half 121*b* is shown in FIG. 13 and the first split half 121*a* in FIG. 14. The split halves 121*a* and 121*b* may alternatively be joined with each other via an adhesive or by any other suitable technique. The bottomed tube 120*a* of the main body 120 has a bottomed end, which constitutes the bottom face of the main body 120, and an inclined opening end to form an inclined opening 122. In the description below, the opening end 122 of the lipstick case 110 is referred to as the upper side and the bottomed end as the lower side.

A horizontal shaft 131*b* involved in opening and closing operations of the cover 130 as discussed below is arranged in the vicinity of the lower end of the inclined opening 122 on the joint of the first and the second split halves 121*a* and 121*b*. An attachment groove 134 extending from the opening 122 to a predetermined length along the longitudinal axis of the tube 120*a* is arranged on the upper end of the inclined opening 122, and an attachment projection 135 below the attachment groove 134. A guide cut 136 is formed at the intermediate portion of the opening 122 between the horizontal shaft 131*b* and the attachment groove 134. The depth of the guide cut 136 is gradually decreased towards the inside of the tube 120*a*. The attachment groove 134, the attachment projection 135, and the guide cut 136 are constituents relating to the attachment and detachment of the predetermined section including the lipstick K and described later in greater detail. Referring to FIG. 14, a cam groove 172 is formed in the inner wall of the first split half 121*a* of the main body 120. The cam groove 172 is included in the lifting mechanism 160 and described later in a greater detail.

The cover 130 functions to open and close the opening 122 of the main body 120. The cover 130 has a hinge 131, which is constructed by inserting the horizontal shaft 131*b* through a hole of a protrusion 131*a* formed at a predetermined position in the vicinity of the circumference of the cover 130. The cover 130 is supported by the hinge 131 to freely open and close the opening 122 of the tube 120*a*. The cover 130 is press-opened by means of the upper end of the sleeve 140 to enable the lipstick K to be protruded from the lipstick case 110 as discussed below. The hinge 131 is structured to apply a predetermined resistance at the time of opening or closing the cover 130. Application of a certain force to the cover 130 in the opening direction thus allows the cover 130 to be opened and held at a desirable angle.

An inclined ring projection 132, which is extended from the bottom face of the cover 130, is fitted in the inclined opening 122 when the cover 130 is in closed position. An engagement pawl 132*a* is arranged at a predetermined position on the side face of the inclined ring projection 132 of the cover 130. When the cover 130 is in the closed position, the engagement pawl 132*a* is received in an engagement recess 133*a*, which is formed at a corresponding position inside the opening 122 of the main body 120. Engagement of the engagement pawl 132*a* with the engagement recess 133*a* and its release ensure a moderate touch when the cover 130 is closed and opened. This structure further prevents the cover 130 from being undesirably opened by an unintentional force once the cover 130 is closed.

The sleeve 140 is accommodated in the tube 120*a* to be freely slidable along the longitudinal axis of the tube 120*a*. The support member 150 for supporting the lipstick K is disposed in the sleeve 140 to be slidable along the longitudinal axis. The sleeve 140 has sufficient length to receive the whole length of the lipstick K supported by the support member 150. The upper ends of the sleeve 140 and the lipstick K form inclined faces, which are substantially in parallel with the inclined opening 122 of the tube 120*a*. The cross sections of the sleeve 140, the support member 150, and the lipstick K have a substantially circular shape. The lower portion of the lipstick K is fitted in and supported by the support member 150.

Figures 15A, 15B, 15C:
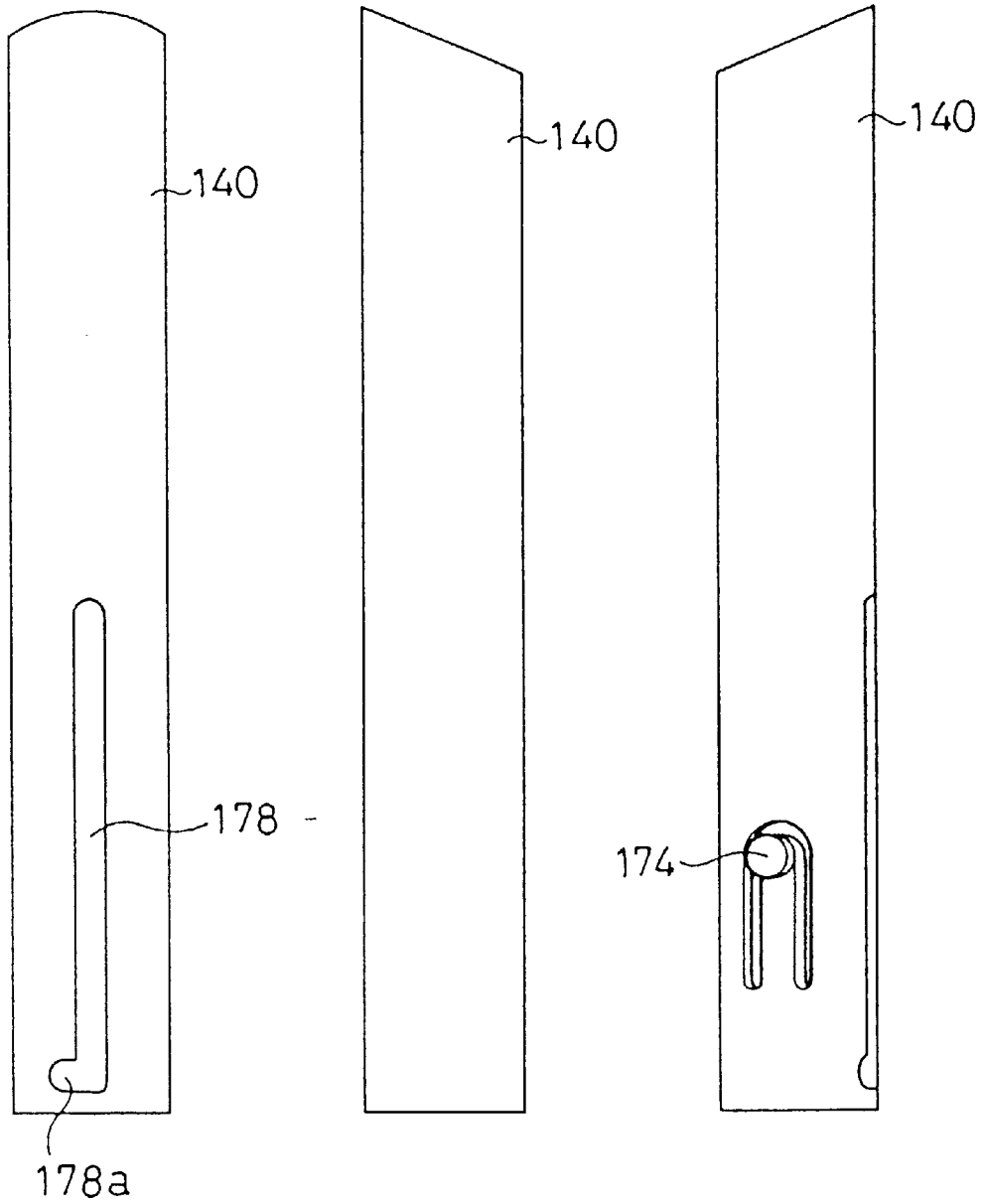
FIGS. 15(A)–15(C) show the appearance of the sleeve 140.
Figure 16:
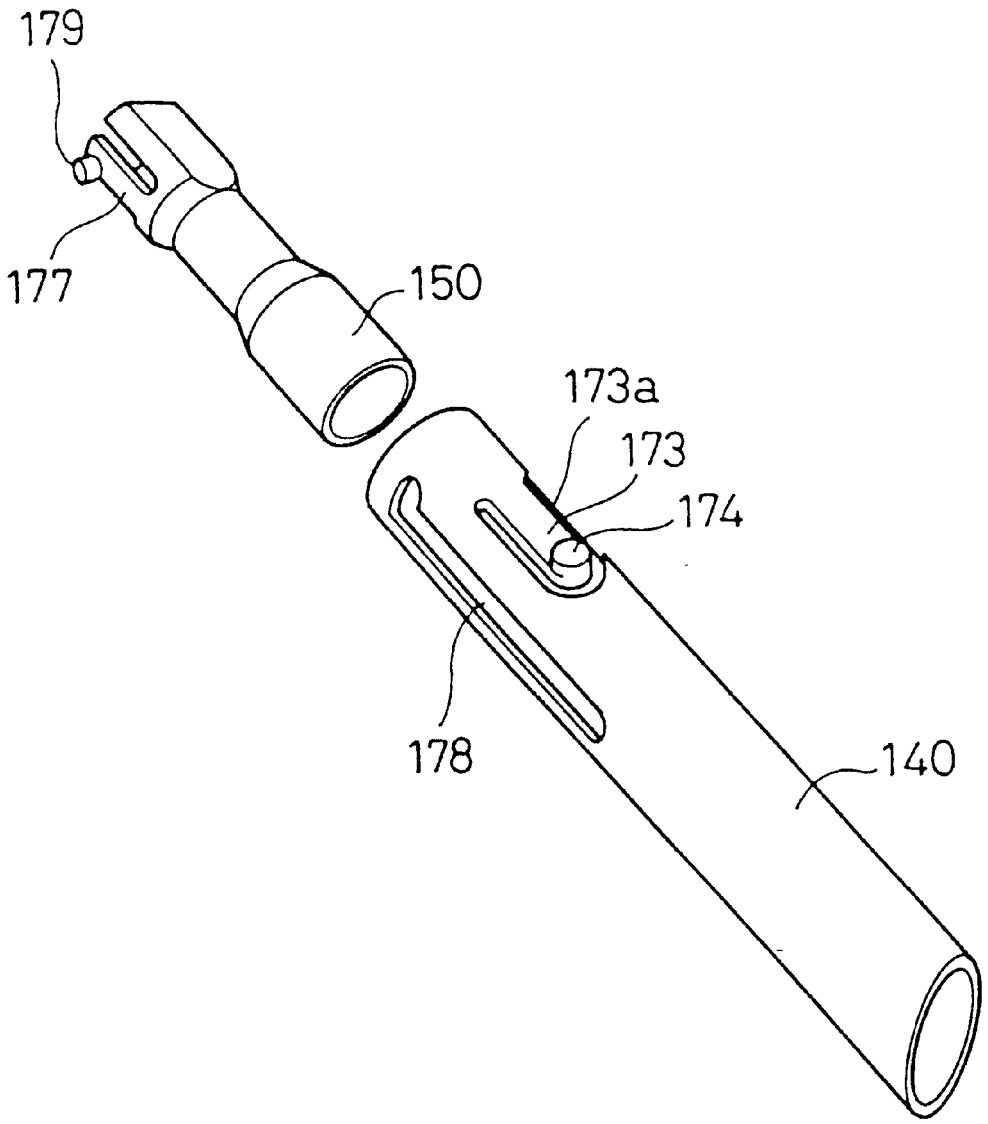
FIG. 16 is a decomposed perspective view showing the support member 150 detached from the sleeve 140.

FIG. 15 shows the appearance of the sleeve 140 as seen from three different directions; and FIG. 16 is a decomposed perspective view showing the support member 150 detached from the sleeve 140. The sleeve 140 is provided with a first sliding piece 174 and a guide groove 178, while the support member 150 has a second sliding piece 179, which passes through the guide groove 178 to be protruded externally when the support member 150 is accommodated in the sleeve 140. The first sliding piece 174, the guide groove 178, and the second sliding piece 179 are constituents involved in protrusion of the lipstick K from the lipstick case 110 and described later in greater detail.

The lifting mechanism 160 realizes the protrusion of the lipstick K from the lipstick case 110. The lifting mechanism 160 includes an operating member 162, a belt 164, the cam groove 172, the first sliding piece 174, the guide groove 178, and the second sliding piece 179. The lifting mechanism 160 transmits the sliding movement of the operating member 162 to the sleeve 140 and the support member 150 for supporting the lipstick K, thereby enabling the sleeve 140 and the support member 150 to move up and down in the tube 120*a* of the main body 120. The following describes the detailed structure of the constituents of the lifting mechanism 160 as well as the operation of protruding the lipstick K from the lipstick case 110.

The user operates the operating member 162 with a finger to enable the lipstick K to be protruded from and accommodated into the lipstick case 110. The operating member 162 is fitted in a control slot 120*d* (see FIGS. 13 and 14) formed along the longitudinal axis on the side wall of the main body 120 and is slidable between an upper-most position and a lower-most position along the control slot 120*d*. The control slot 120*d* is arranged on the same side as the hinge 131 of the cover 130 on the joint of the first and the second split halves 121*a* and 121*b* of the tube 120*a*.

The operating member 162 is integrally formed with a first end of the belt 164, which is composed of a resilient material. The width of the belt 164 is held by a belt sliding groove 164*a* formed in the main body 120, so that the belt 164 is slidingly movable in the belt sliding groove 164*a*. As shown in FIG. 14, the belt sliding groove 164*a* is arranged around the tube 120*a* and is formed as a U-shaped slit having a curve gradually bent on the lower end portion of the main body 120. A predetermined lubricant is applied on both the faces of the belt 164. Application of the lubricant keeps the frictional force generated between the belt 164 and the belt sliding groove 164*a* within a predetermined desirable range.

When the lipstick K is thoroughly accommodated in the lipstick case 110, the operating member 162 is located on an upper end of the U-shaped belt sliding groove 164*a* (that is, at the position shown in FIGS. 11 (B) and (C)). As the user slides down the operating member 162 towards the lower bend of the U-shaped belt sliding groove 164*a* (that is, towards the position shown in FIG. 11(D)), the lipstick K is gradually protruded from the lipstick case 110. Simultaneously, a second end of the belt 164 slides along the belt sliding groove 164*a* and moves up from the position in the vicinity of the bottom face of the main body 120 (that is, from the position shown in FIG. 12) to the position in the vicinity of the opening 122 (that is, to the position shown in FIG. 14). A connection hole 175 is formed on the second end of the belt 164. The second sliding piece 179 is fitted in the connection hole 175, so that the sliding movement of the operating member 162 operated by a certain force is transmittable to the sleeve 140 and the support member 150. The mechanism of transmitting the sliding movement of the operating member 162 and lifting up and down the sleeve 140 and the support member 150 will be described later in greater detail.

When the user slides up or down the operating member 162, the frictional force kept in the predetermined desirable range acts between the belt 164 and the belt sliding groove 164*a*. Especially at the bend of the U-shaped belt sliding groove 164*a* on the lower end of the main body 120, the frictional force resists the movement of the belt 164. This enables the user to halt the sliding operation of the operating member 162 halfway and hold the sleeve 140 and the support member 150 at an arbitrary position. Although the operating member 162 is integrally formed with the first end of the belt 164 in this embodiment, the operating member 162 and the belt 164 may be manufactured separately and joined with each other via an adhesive or assembled by fitting.

As discussed above, the sleeve 140 is provided with the first sliding piece 174 and the guide groove 178, whereas the support member 150 has the second sliding piece 179. Referring to FIG. 16, the first sliding piece 174 is disposed on one end of a first leaf spring 173, which is formed by making a U-shaped cut 173*a* at a predetermined position on the sleeve 140. The guide groove 178 is a slit formed along the longitudinal axis of the sleeve 140 and is bent at a substantially right angle on the lower end thereof to form a horizontal slot 178*a* as shown in FIG. 15. When the support member 150 is fitted into the sleeve 140, the second sliding piece 179 on the support member 150 passes through the guide groove 178 and is protruded from the sleeve 140. Referring to FIG. 16, the second sliding piece 179 is disposed on the end of a second leaf spring 177, which is formed by making a cut on the lower end of the support member 150. Although the second sliding piece 179 is formed separately from the support member 150 as shown in FIG. 12 in this embodiment, the second sliding piece 179 may be formed integrally with the support member 150.

When the sleeve 140 with the support member 150 attached therein is received in the main body 120, the second sliding piece 179 on the support member 150 passes through the guide groove 178 and is fitted in the connection hole 175 formed on the second end of the belt 164. Connection of the second sliding piece 179 with the belt 164 enables the sliding movement of the operating member 162 to be transmitted to the sleeve 140 and the support member 150. Byway of example, when the user slides down the operating member 162 from its upper-most position shown in FIG. 11(B), the position of the connection hole 175 moves up along the belt sliding groove 164*a*. The second sliding piece 179 fitted in the connection hole 175 is also lifted up with the connection hole 175. When case that the second sliding piece 179 passing through the guide groove 178 is held in the horizontal slot 178*a* of the guide groove 178, the sleeve 140 and the support member 150 move up together as a unit. The lipstick K accommodated in the sleeve 140 accordingly does not move relative to the sleeve 140 but goes up together with the sleeve 140.

When the second sliding piece 179 is released from the horizontal slot 178*a* of the guide groove 178 while the sleeve 140 is held at a predetermined position, the support member 150 slides up in the sleeve 140. This enables the lipstick K in the sleeve 140 to move up relative to the sleeve 140.

The cam groove 172 is formed in the inner wall of the tube 120*a* as described previously. The first sliding piece 174 formed on the sleeve 140 is fitted in the cam groove 172 under the condition that the sleeve 140 is accommodated in the main body 120. When the sliding movement of the operating member 162 is transmitted to the sleeve 140 via the second sliding piece 179, the first sliding piece 174 on the sleeve 140 slides along the cam groove 172, so that the sleeve 140 lifts up or down in the tube 120*a* of the main body 120. Referring to FIG. 14, the cam groove 172 includes a linear slot 172*b* formed along the longitudinal axis of the tube 120*a* and a cam slot 172*a* bent in one direction (towards the hinge 131) on the upper end of the linear slot 172*b*. When the sleeve 140 moves up and the position of the first sliding piece 174 is changed from the linear slot 172*b* to the cam slot 172*a*, the sleeve 140 is rotated a little according to the shape of the cam slot 172*a* in its bending direction. The first sliding piece 174 eventually reaches the end of the cam slot 172*a* and stops there, when the sleeve 140 also stops moving up. The cam slot 172*a* of the cam groove 172 rotates the sleeve 140 so as to release the second sliding piece 179 from the horizontal slot 178*a* of the guide groove 178 and make the second sliding piece 179 slidable along the guide groove 178, while holding the sleeve 140 at the predetermined position.

Figure 17:
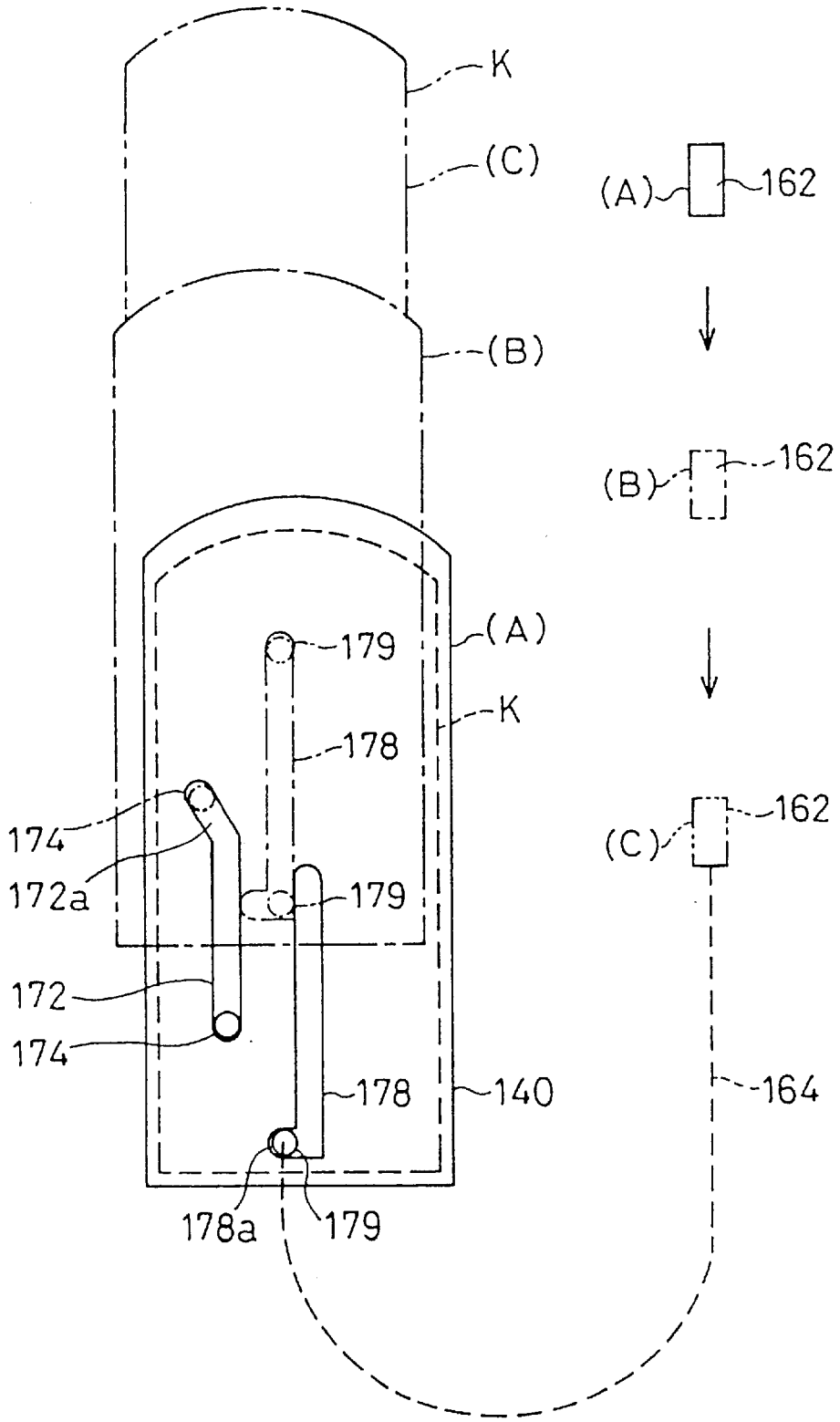
FIG. 17 shows the engagement states of the first sliding piece 174 and the second sliding piece 179 when the lipstick K is protruded from the main body 120.

The following describes the working process of the lifting mechanism 160 when the user operates the operating member 162 to make the lipstick K protrude from the lipstick case 110. FIG. 17 shows a series of movements of the lifting mechanism 160 in the course of operation for protruding the lipstick K from the lipstick case 110. More concretely, the drawing of FIG. 17 shows the engagement state of the first sliding piece 174 with the cam groove 172, the engagement state of the second sliding piece 179 with the guide groove 178, and the state of protrusion of the sleeve 140 and the lipstick K corresponding to the respective positions of the operating member 162. In the drawing of FIG. 17, the rotation of the sleeve 140 is expressed as a movement on the plane.

In the state of FIG. 11(B), the opening 122 of the tube 120*a* is closed with the cover 130, and the lipstick K is thoroughly accommodated in the main body 120. Under such conditions, the operating member 162 is located at its upper-most position, that is, the upper end of the control slot 120*d*, whereas the first sliding piece 174 engages with the lower end of the cam groove 172 formed in the inner wall of the main body 120 and the second sliding piece 179 fitted in the connection hole 175 formed on the second end of the belt 164 engages with the horizontal slot 178*a* of the guide groove 178 (corresponding to the state of FIG. 17(A)).

When the user slides down the operating member 162 from its upper-most position, the belt 164, whose first end is integrally formed with the operating member 162, slidingly moves in connection with the movement of the operating member 162. As discussed previously, with the downward sliding movement of the operating member 162, the second end of the belt 164 with the connection hole 175 slides up along the belt sliding groove 164*a*. The support member 150 with the second sliding piece 179 then goes up in connection with the movement of the belt 164. Since the second sliding piece 179 engages with the horizontal slot 178*a* of the guide groove 178 formed in the sleeve 140, the support member 150 and the sleeve 140 move up together as a unit. When the operating member 162 is slid by a predetermined distance, the upper end of the lifted sleeve 140 comes into contact with the ring projection 132 of the cover 130. When the user further slides down the operating member 162, the upper end of the sleeve 140 press-opens the cover 130 and goes up beyond the ring projection 132, so that the sleeve 140 is protruded from the opening 122 of the main body 120.

A further downward sliding movement of the operating member 162 enables the first sliding piece 174 to be led up along the linear slot 172*b* of the cam groove 172 and reach the cam slot 172*a* formed on the upper end of the cam groove 172. As described previously, the cam slot 172*a* is bent in the predetermined direction, so that the sleeve 140 is rotated a little when the first sliding piece 174 is led into the cam slot 172*a*. The slight rotation of the sleeve 140 releases the second sliding piece 179 from the horizontal slot 178*a* of the guide groove 178 (corresponding to the state of FIG. 17(B)).

When the user continues sliding down the operating member 162, the first sliding piece 174 engaging with the upper end of the cam groove 172 keeps the sleeve 140 at its position. At this moment, since the second sliding piece 179 is released from the engagement with the horizontal slot 178*a*, the movement of the belt 164 lifts up only the support member 150. This causes the lipstick K held by the support member 150 (in the drawing of FIG. 17, the symbol 'K' represents both the lipstick K and the support member 150) to move up and be protruded from the opening 122 and the upper end of the sleeve 140 (corresponding to the state of FIGS. 17(C) and 11(D)). The lipstick is now ready for use.

When the user slides up the operating member 162 from the lower-most position in which the lipstick K is protruded from the opening 122 and the upper end of the sleeve 140, on the contrary, the lipstick K fixed to the support member 150 moves down and is accommodated into the sleeve 140, which is subsequently accommodated into the main body 120 thoroughly, in reverse sequence. The user then presses down the cover 130 to close the opening 122 of the main body 120 and return the lipstick case 110 to the initial state (corresponding to the state of FIGS. 11(A) through 11(C)).

The lipstick case 110 having the lifting mechanism 160 discussed above is further provided with the attachment mechanism 180, which enables the used lipstick K to be replaced by a new lipstick K. The following describes the attachment mechanism 180 included in the lipstick case 110 of the second embodiment and a concrete procedure of attaching and detaching the lipstick K to and from the lipstick case 110.

The mechanism and process of detaching the predetermined section including the lipstick K from the main body 120 are described first. In the lipstick case 110 of the second embodiment, the sleeve 140 and the support member 150 for supporting the lipstick K can be attachable and detachable together with the lipstick K. In the description below, the set of detachable members including the sleeve 140 and the support member 150 for supporting the lipstick K is referred to as a cartridge unit 182 (see FIG. 12) The cartridge unit 182 can be detached from the main body 120 in the following manner. The user first slides down the operating member 162 to its lower-most position to make the sleeve 140 protrude from the opening 122 of the main body 120. It is here assumed that the lipstick K has already been used up and no portion of the lipstick K appears from the upper end of the sleeve 140 as shown in FIG. 18.

Figure 18:
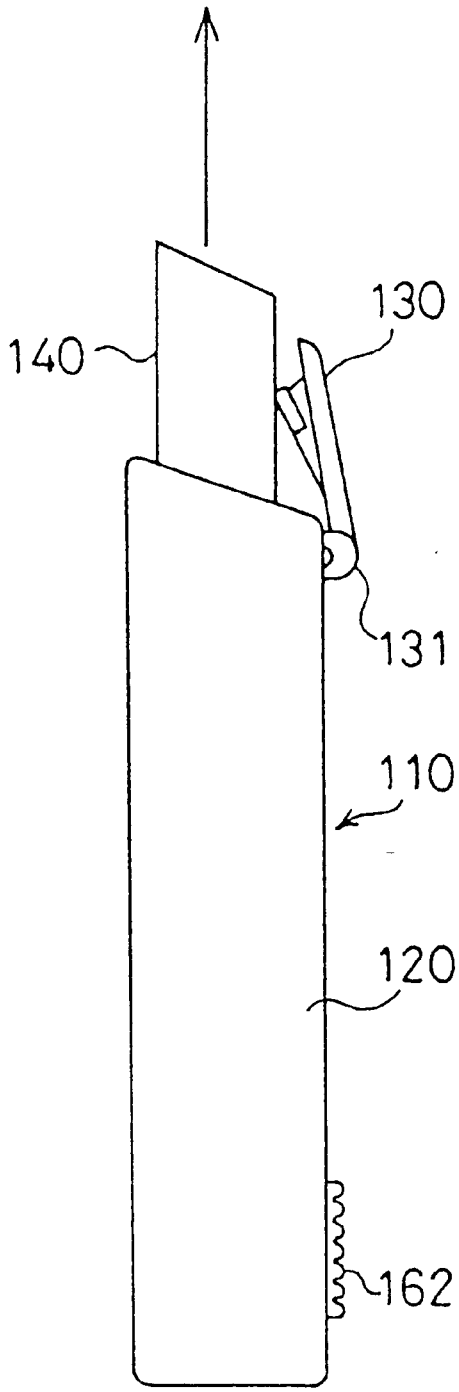
FIG. 18 shows the appearance of the lipstick case 110 after the lipstick K has been used up.

The cartridge unit 182 is detached by pulling the sleeve 140 up in the vertical direction as shown by the arrow in the drawing of FIG. 18. When the sleeve 140 is pulled up, the first sliding piece 174 formed on the sleeve 140 slips out of the cam groove 172. Application of the force for pulling up the sleeve 140 naturally makes the upper end of the cam groove 172 press against the first sliding piece 174. Since the first sliding piece 174 is disposed on the end of the first leaf spring 173 as described above, however, the first leaf spring 173 of the sleeve 140 is pressed inward in the radial direction of the sleeve 140 and enables the first sliding piece 174 to be slipped off the cam groove 172.

After the first sliding piece 174 comes off the cam groove 172, the sleeve 140 is further pulled up while the first leaf spring 173 with the first sliding piece 174 is being pressed. Even when the sleeve 140 is pulled up, the support member 150 does not substantially move since the second sliding piece 179 formed on the support member 150 is fitted in the connection hole 175 of the belt 164. With the upward movement of the sleeve 140, the relative position of the second sliding piece 179 in the guide groove 178 moves from the upper end to the lower end of the guide groove 178.

When the user further pulls up the sleeve 140 and the second sliding piece 179 comes into contact with the lower end of the guide groove 178, the second sliding piece 179 receives a pressing force from the belt 164 with the connection hole 175. As discussed previously, the second sliding piece 179 is disposed on the end of the second leaf spring 177. Application of such a pressing force makes the second sliding piece 179 of the support member 150 press inward in the radial direction of the support member 150 and slip out of the connection hole 175. Once the second sliding piece 179 comes off the connection hole 175, the used cartridge unit 182 can readily be pulled off the main body 120.

Figure 19:
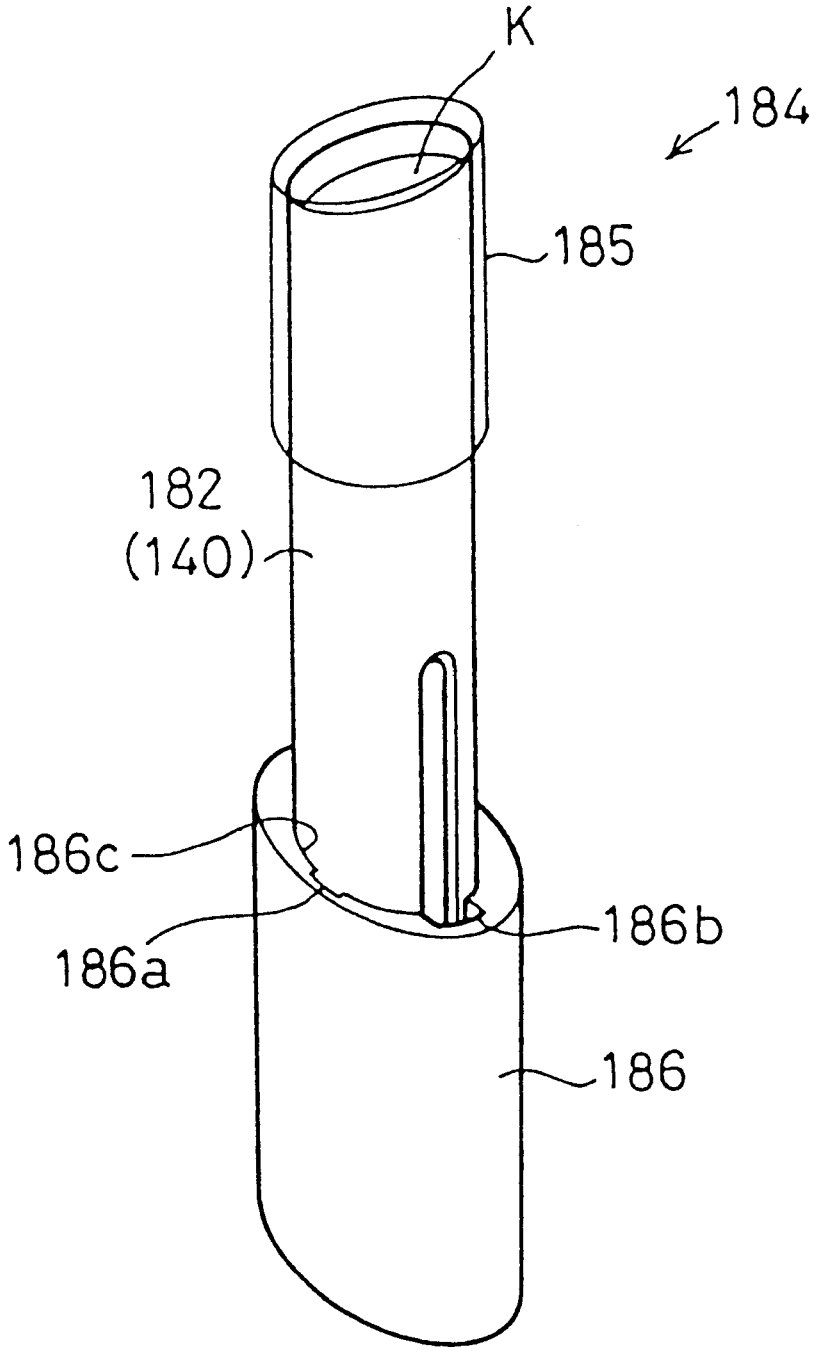
FIG. 19 is a perspective view illustrating the appearance of a cartridge 184.

The following describes the mechanism and process of attaching a new lipstick K to the main body 120. FIG. 19 is a perspective view-showing a cartridge 184, which includes the cartridge unit 182 consisting of the sleeve 140 and the support member 150 for supporting the lipstick K. The cartridge 184 includes a cap 185 for protecting the upper portion of the sleeve 140 and a bottom cover 186 for covering the lower portion of the sleeve 140, in addition to the cartridge unit 182.

The cap 185 is made of a transparent acrylic resin and has an inclined upper end corresponding to the inclined upper end of the sleeve 140, in which the lipstick K is accommodated. The bottom cover 186 includes a cartridge-receiving cavity 186*c*, in which the cartridge unit 182 is received. The cartridge-receiving cavity 186*c* has a first engagement slot 186*a* and a second engagement slot 186*b* formed along the longitudinal axis thereof. In the state that the cartridge unit 182 is received in the bottom cover 186, the first engagement slot 186*a* engages with the first sliding piece 174 and the second engagement slot 186*b* with the second sliding piece 179. The relative position of the first engagement slot 186*a* to the second engagement slot 186*b* corresponds to the relative position of the first sliding piece 174 to the second sliding piece 179 fitted in the horizontal slot 178*a* of the guide groove 178. When the cartridge unit 182 is received in the bottom cover 186, the second sliding piece 179 is kept to engage with the horizontal slot 178*a* of the guide groove 178.

A new cartridge unit 182 is attached to the main body 120 in the following manner. The bottom cover 186 is detached from the cartridge unit 182 having the cap 185. In the meantime, the main body 120 is ready for the attachment, when the operating member 162 on the main body 120 is kept at its lower-most position. In other words, the main body 120 is kept in the same state after the used cartridge unit 182 has been pulled out. While the operating member 162 is kept at its lower-most position in the control slot 120*d* and the second sliding piece 179 is fitted in the horizontal slot 178*a* of the guide groove 178, the user moves the second sliding piece 179 along the attachment groove 134 (see FIGS. 13 and 14) and presses the sleeve 140 into the tube 120*a* of the main body 120.

Once the sleeve 140 is pressed into the tube 120*a*, the second sliding piece 179 on the support member 150 is gradually pressed inward in the radial direction of the support member 150 according to the shape of the attachment groove 134 before coming into contact with the attachment projection 135 (see FIGS. 13 and 14). When the sleeve 140 is further pressed in, the second sliding piece 179 goes over the attachment projection 135 and reaches the vicinity of the connection hole 175 formed in the second end of the belt 164 (see FIG. 14). The second sliding piece 179, which is formed on the second leaf spring 177, is pressed back by the resilience of the second leaf spring 177 when going over the attachment projection 135. This enables the second sliding piece 179 to be fitted into the connection hole 175 of the belt 164 with a moderate touch.

While the second sliding piece 179 is fitted into the connection hole 175, the first sliding piece 174 approaches the opening 122 of the tube 120*a*. As discussed previously, the opening 122 has the guide cut 136, which is formed at a predetermined position to receive the first sliding piece 174 while the second sliding piece 179 engages with the horizontal slot 178*a* of the guide groove 178. When the second sliding piece 179 is fitted into the connection hole 175, the guide cut 136 accordingly enables the first sliding piece 174 to be led into the tube 120*a* of the main body 120. The first sliding piece 174, which is formed on the first leaf spring 173, is gradually pressed inward in the radial direction of the sleeve 140 according to the shape of the guide cut 136, so that the sleeve 140 is led into the main body 120 without difficulties.

Once the second sliding piece 179 is re-engaged with the connection hole 175, the sliding movement of the operating member 162 becomes transmittable to the sleeve 140 and the support member 150. The user slides up the operating member 162 when the second sliding piece 179 has been fitted in the connection hole 175 and the first sliding piece 174 has been led into the main body 120. The upward sliding movement of the operating member 162 makes the sleeve 140 with the support member 150 held on the lower end thereof go down in the tube 120*a*. When the sleeve 140 continues going down to a predetermined position, the cap 185 of the cartridge 184 comes into contact with the opening 122. A further upward sliding movement of the operating member 162 enables the cap 185 to be held on the opening 122 and removed from the upper end of the sleeve 140. This allows the lipstick K received in the sleeve 140 to be accommodated into the tube 120*a* without being exposed to contact with the exterior. The user may alternatively remove the cap 185 with a hand.

Under such conditions, the first sliding piece 174 reaches the upper end portion of the cam groove 172. Since the second sliding piece 179 engages with the horizontal slot 178*a* of the guide groove 178, the first sliding piece 174 is fitted not into the cam slot 172*a* but into the linear slot 172*b* of the cam groove 172. The first sliding piece 174 then moves down along the linear slot 172*b* of the cam groove 172 and eventually reaches the lower end of the cam groove 172, when the operating member 162 reaches its upper-most position. The user subsequently presses down the cover 130 to close the opening 122 of the main body 120 and return the lipstick case 110 to the initial state (corresponding to the state of FIGS. 11(A) through 11(C)).

In the lipstick case 110 of the second embodiment thus constructed, a simple sliding operation of the operating member 162 readily makes the lipstick K ready for use. The structure of the second embodiment further allows the main body 120 to be reusable by simply replacing the old cartridge 184 with the used-up lipstick K by a new cartridge 184 with a new lipstick K. The cartridge unit 182 can readily be detached from the main body 120 by simply pulling off the sleeve 140 and attached to the main body 120 by adjusting the position, pressing the sleeve 140 into the tube 120*a*, and sliding up the operating member 162. In this manner, the user can readily attach and detach the cartridge unit 182 to and from the main body 120 according to the requirements.

In the lipstick case 110 of the second embodiment, the cartridge unit 182 is linked with the main body 120 at only the two sites via the engagement of the first sliding piece 174 with the cam groove 172 and the engagement of the second sliding piece 179 with the connection hole 175. This structure realizes the lifting mechanism 160 as discussed above. The cartridge unit 182 can readily be attached to and detached from the main body 120 since the cartridge unit 182 is connected with the main body 120 at only the two sites. The first sliding piece 174 and the second sliding piece 179 are respectively formed on the ends of the first leaf spring 173 and the second leaf spring 177 as discussed previously. These sliding pieces 174 and 179 are accordingly pressed inward in the course of the attachment of the cartridge unit 182, so that the cartridge unit 182 is readily introduced into the tube 120*a*.

The attachment groove 134 and the guide cut 136 formed at the opening 122 of the tube 120*a* especially ease the insertion of the first sliding piece 174 and the second sliding piece 179. The distance between the attachment groove 134 and the guide cut 136 is determined corresponding to the distance between the first sliding piece 174 on the sleeve 140 and the second sliding piece 179 fitted in the horizontal slot 178*a* of the guide groove 178. This structure allows the attachment of the cartridge unit 182 to the main body 120 while the second sliding piece 179 is fitted in the horizontal slot 178*a*. The attachment projection 135 formed on one end of the attachment groove 134 as well as the first spring leaf 173 gives a moderate touch in the process of inserting the first sliding piece 174.

The cartridge 184 of the second embodiment includes the sleeve 140 having sufficient length to cover the whole length of the lipstick K received therein. This configuration effectively prevents the side face of the lipstick K accommodated in the cartridge 184 from being damaged in storage or in the process of attachment or detachment but keeps the lipstick K under preferable sanitary conditions. The cap 185 arranged on the upper end of the cartridge 184 further protects the upper end of the lipstick K. When the lipstick K is accommodated in the sleeve 140, the upper end face of the lipstick K is kept apart from the upper end of the sleeve 10 by a predetermined distance (see FIGS. 12 and 19). The upper end of the sleeve 140 with the lipstick K received in this manner is covered with the cap 185, and the upper end face of the lipstick K is thus not exposed to contact with the exterior but is kept under preferable sanitary conditions.

In the cartridge 184 of the second embodiment, the cap 185 is composed of a transparent acrylic resin. The transparent cap 185 allows the user to visually check the lipstick K received in the sleeve 140. The user can accordingly check the color of a new lipstick K held in the newly replaced cartridge unit 182. Some protection member, such as a sponge, may be set in the cap 185 to further protect the upper end face of the lipstick K. Even when the support member 150 is mistakenly lifted up in the course of the attachment of the cartridge 184 to the main body 120, the protection member effectively prevents the upper end face of the lipstick K from being directly pressed against the inner wall of the cap 185.

The cap 185 is attached to the cartridge unit 182 by fitting the upper end of the sleeve 140 in the cap 185 and is thus readily removed by applying an upward pulling force in the vertical direction. As discussed above, the cap 185 can be readily removed from the upper end of the sleeve 140 in the process of the attachment of the cartridge unit 182 to the main body 120 simply by lifting down the sleeve 140 while the cap 185 is in contact with the opening 122 of the tube 120*a*. This structure effectively prevents the upper end of the lipstick K from being exposed to contact with the exterior in the course of the attachment of the cartridge unit 182. The cap 185 accordingly protects the upper end of the lipstick K from damages and realizes the replacement of the cartridge unit 182 in a preferable sanitary state. When some protection member is set in the cap 185, the protection member may be bonded to the inner wall of the cap 185 and removed together with the cap 185. Alternatively, the protection member maybe peeled off the upper end of the lipstick K after the cap 185 is separately removed.

In the cartridge 184 of the embodiment, the upper end portion of the lipstick K is protected by the cap 185. A film or similar member may, however, be used in place of the cap 185 to cover the upper end portion of the lipstick K. In accordance with such modified structure, a film member of a certain shape for covering the upper end portion of the sleeve 140 is applied to the sleeve 140 via a predetermined adhesive or the like. When the film member is composed of a transparent material, the user can easily check the color of a new lipstick K received in the newly replaced cartridge unit 182.

The cartridge 184 of the embodiment further includes the bottom cover 186, which protects the lower portion of the sleeve 140 and prevents the second sliding piece 179 from being in contact with the exterior. The bottom cover 186 set around the cartridge unit 182 thus prevents the second sliding piece 179 from being mistakenly pressed up and lifting the support member 150 up. The bottom cover 186 is provided with the first engagement slot 186*a* and the second engagement slot 186*b* as described above. This configuration enables the second sliding piece 179 to be kept in the horizontal slot 178*a* of the guide groove 178 while the bottom cover 186 is set on the cartridge unit 182. The first engagement slot 186*a* and the second engagement slot 186*b* are formed in parallel to each other along the longitudinal axis of the bottom cover 186. The user can thus readily remove the bottom cover 186 by pulling the cartridge unit 182 off the bottom cover 186 along its longitudinal axis for the subsequent attachment procedure discussed above, whereas the second sliding piece 179 is kept in the horizontal slot 178*a* of the guide groove 178.

In the lipstick case 110 of the second embodiment, the cartridge unit 182 is attached to the main body 120 under the condition that the second sliding piece 179 is fitted in the horizontal slot 178*a*. This structure enables the cartridge unit 182 to be readily attached to the main body 120 according to the attachment steps described above, while the lipstick K is not exposed to contact with the exterior but is kept under preferable sanitary conditions. The structure of the lipstick case 110 of this embodiment further allows the cartridge unit 182 to be attached without significant troubles even when the second sliding piece 179 is unintentionally released from the horizontal slot 178*a* of the guide groove 178. The following describes the attachment procedure in case that the second sliding piece 179 is released from the horizontal slot 178*a*.

In the same manner as discussed above, the second sliding piece 179 is fitted into the connection hole 175 of the belt 164 with a moderate touch by moving the second sliding piece 179 along the attachment groove 134 and pressing the sleeve 140 into the tube 120*a*. At this moment, since the second sliding piece 179 is not engaged with the horizontal slot 178*a*, the support member 150 becomes movable along the longitudinal axis of the sleeve 140. This may cause the lipstick K to be lifted up in the process of fitting the second sliding piece 179 into the connection hole 175. The cap 185 covering the upper end portion of the sleeve 140, however, keeps the lipstick K in the preferable sanitary state, although the upper end of the lipstick K is brought into contact with the inner wall of the cap 185.

Once the second sliding piece 179 is fitted in the connection hole 175 of the belt 164, the operating member 162 can be used for the subsequent steps. An upward sliding movement of the operating member 162 moves the sleeve 140 down in the tube 120*a* and enables the cap 185 to be removed from the sleeve 140 at a predetermined position. When the second sliding piece 179 is released from the horizontal slot 178*a* of the guide groove 178, the first sliding piece 174 is engaged with the upper end of the cam slot 172*a* instead of the linear slot 172*b* of the cam groove 172 formed along the longitudinal axis of the tube 120*a*. With the downward movement of the sleeve 140, the first sliding piece 174 fitted in the upper end of the cam slot 172*a* moves down from the cam slot 172*a* to the linear slot 172*b* and reaches the lower-most end of the cam groove 172, when the operating member 162 reaches its upper-most position. When the user presses down the cover 130 to close the opening 122 of the main body 120 under such conditions, the lipstick case 110 can be returned to its initial state (corresponding to the state of FIGS. 11(A) through 11(C)). Even in case that the second sliding piece 179 is mistakenly released from the horizontal slot 178*a* of the guide groove 178, the cartridge 182 can be attached to the main body 120 without much troubles except that the upper end of the lipstick K may come into contact with the inner wall of the cap 185.

In the lipstick case 110 of the second embodiment, the cartridge unit 182 has the first sliding piece 174 and the second sliding piece 179, which are respectively engaged with the cam groove 172 and the connection hole 175 of the belt 164 on the main body 120. This configuration of the projection-recess engagement may, however, be reversed according to the requirements. Another lipstick case 110A having a lifting mechanism 160A with the reverse configuration of projection-recess engagement to that of the lipstick case 110 of the second embodiment is described as a third embodiment according to the invention. The lipstick case 110A of the third embodiment has a similar structure to that of the lipstick case 110 of the second embodiment except for the configuration of the projection-recess engagement. The symbol 'A' is added to the numerals representing the constituents of the lipstick case 110A, which are identical with or correspond to those of the lipstick case 110. Such constituents may not be specifically described here. The lipstick case 110A of the third embodiment has substantially the same appearance as that of the lipstick case 110 shown in FIG. 11.

Figure 20:
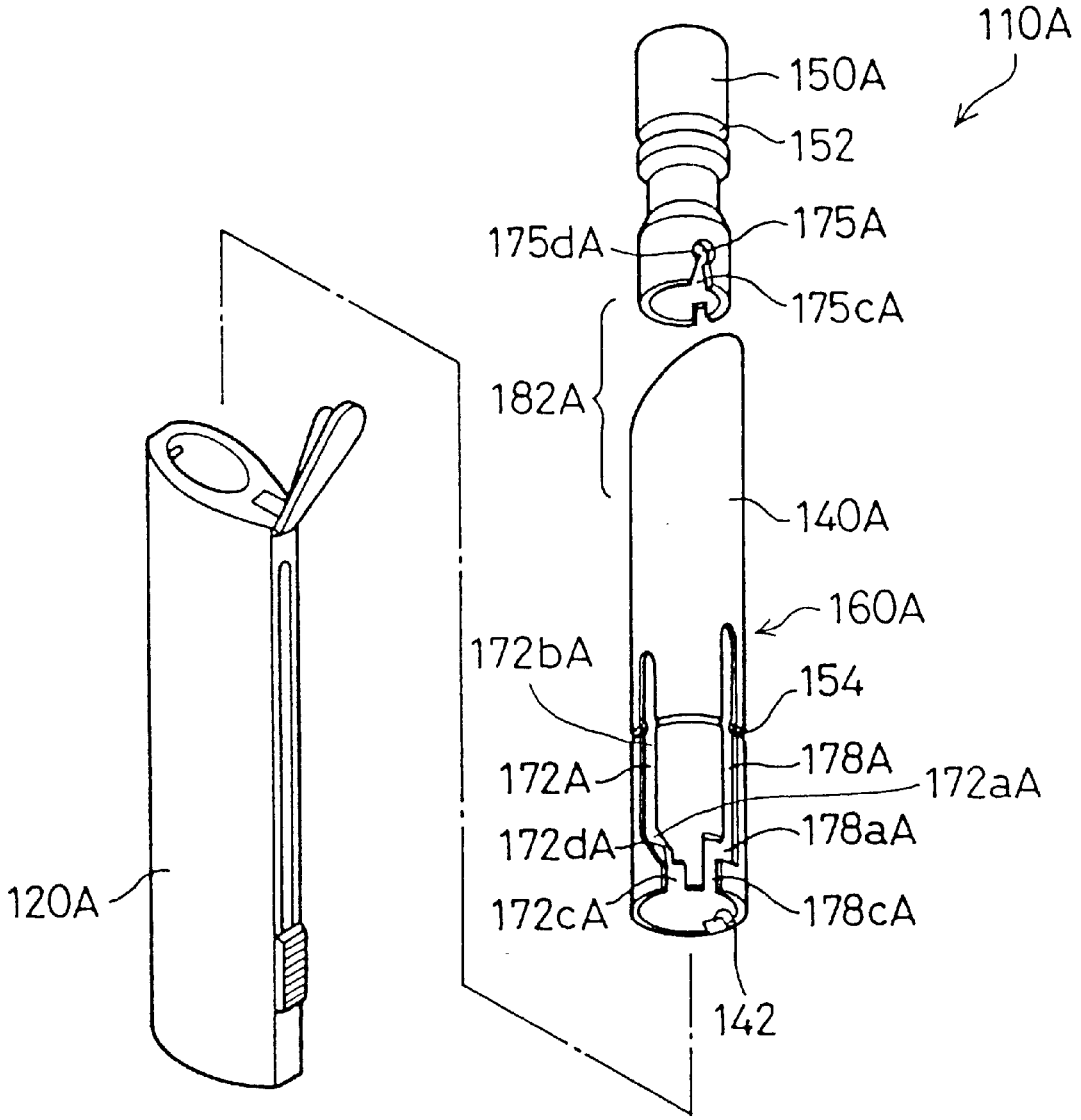
FIG. 20 is a perspective view showing structure of still another lipstick case 110A as a third embodiment according to the present invention.

FIG. 20 is a decomposed perspective view illustrating a main body 120A, a sleeve 140A, and a support member 150A of the lipstick case 110A. While the sleeve 140 of the second embodiment has the guide groove 178 and the first sliding piece 174, the sleeve 140A of the third embodiment has a guide groove 178A and a cam groove 172A. The guide groove 178A and the cam groove 172A respectively have cuts 178*c*A and 172*c*A on the lower end of the sleeve 140A as shown in FIG. 20. This enables a cartridge unit 182A including the sleeve 140A to be attached to and detached from the main body 120A. The support member 150A has a connection hole 175A, instead of the second sliding piece 179 of the second embodiment. The connection hole 175A also has a cut 175*c*A on the lower end of the support member 150A. A constricted element 175*d*A for holding a second sliding piece 179A (described later) is formed on the boundary between the connection hole 175A and the cut 175*c*A. A constricted element 172*d*A for holding a first sliding piece 174A (described later) is formed on the boundary between the cut 172*c*A and a cam slot 172*a*A of the cam groove 172A.

A caulking seat 152 is formed at a predetermined position on the circumference of the support member 150A, whereas a caulked element 154 is disposed on the sleeve 140A at a position corresponding to the caulking seat 152. When the caulked element 154 is received into the caulking seat 152 in the state that the upper end of the lipstick K is set thoroughly in the sleeve 140A, the support member 150A becomes unslidable in the sleeve 140. The cartridge unit 182A is attached to the main body 120A under the condition that the caulked element 152 is received in the caulking seat 154.

Figure 21:
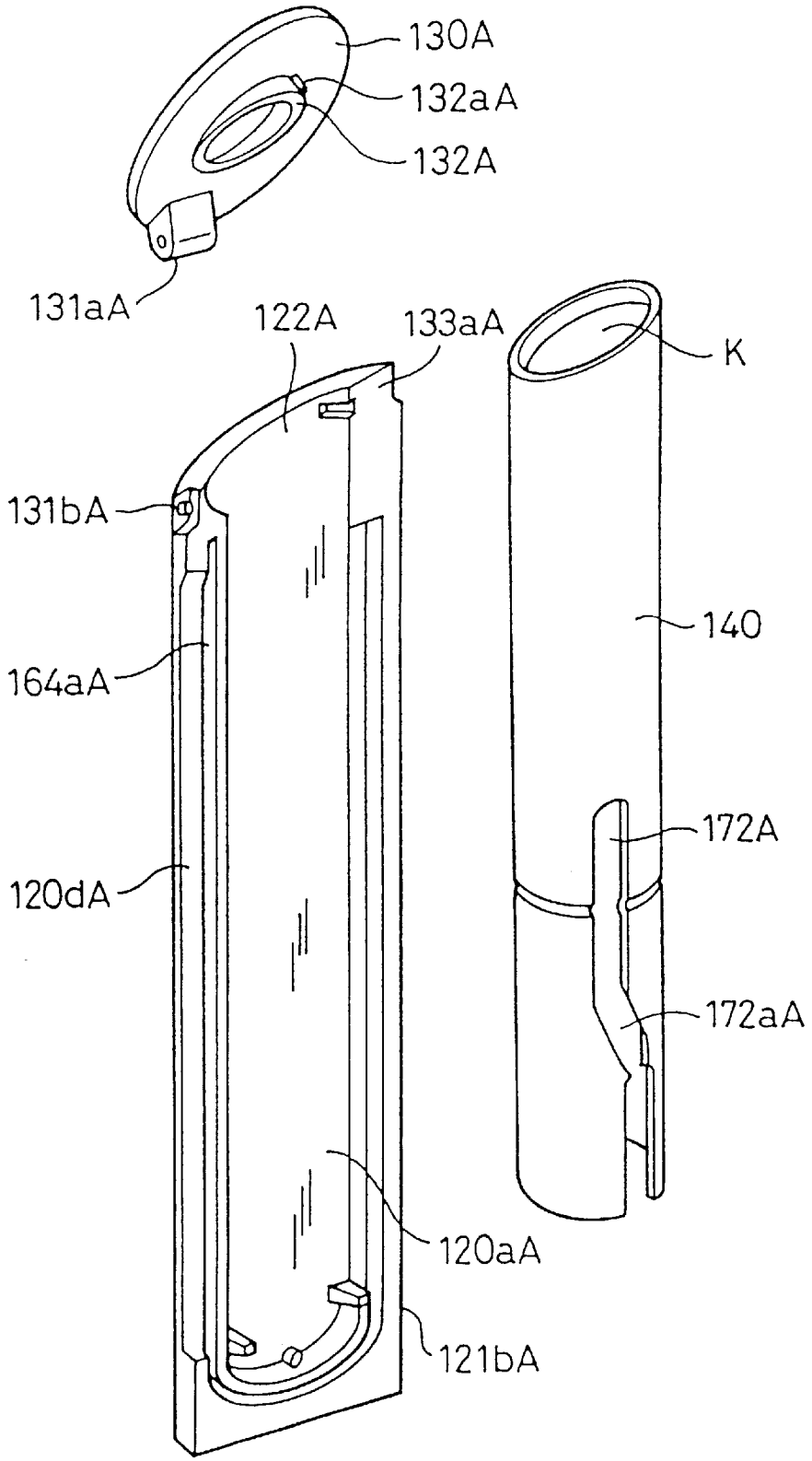
FIG. 21 is a partially decomposed perspective view showing the constituents of the lipstick case 110A.
Figure 22:
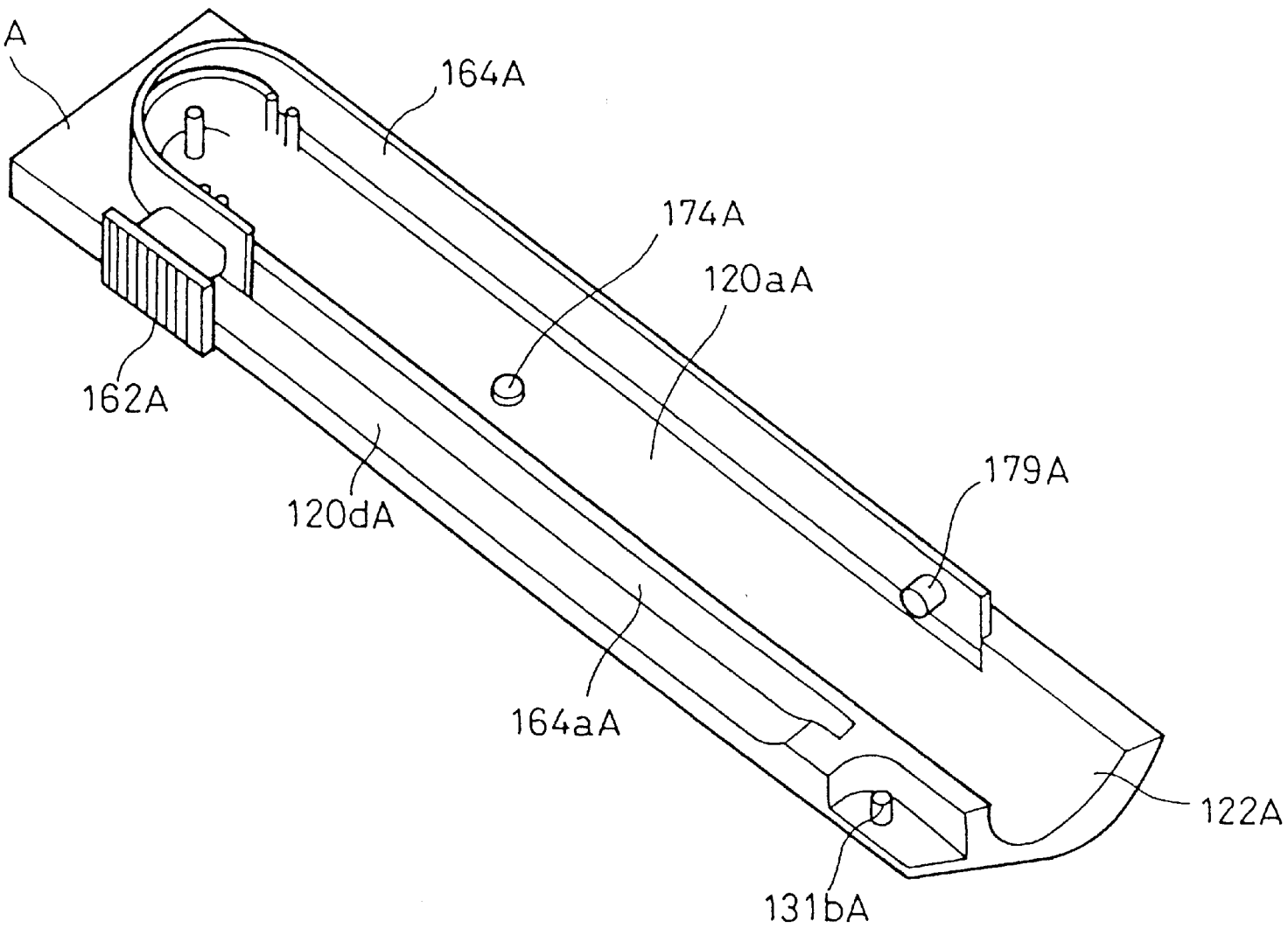
FIG. 22 is a perspective view showing the first split half 121*a*A of the lipstick case 110A.

FIGS. 21 and 22 are perspective views showing the lipstick case 110A in a decomposed condition, which correspond to FIGS. 13 and 14. In the lipstick case 110A of the third embodiment, a belt 164A has a second sliding piece 179A on its second end, instead of the connection hole 175 of the second embodiment. The second sliding piece 179A passes through the guide groove 178A and is fitted into the connection hole 175A formed in the support member 150A.

This structure enables the sliding movement of a operating member 162A fixed to a first end of the belt 164A to be transmitted to the support member 150A and the sleeve 140A. Like the guide groove 178 of the second embodiment, the guide groove 178A includes a horizontal slot 178*a*A on its lower portion. While the second sliding piece 179A of the belt 164A is fitted in the horizontal slot 178*a*A, the sleeve 140A and the support member 150A are lifted up and down together as a unit. When the second sliding piece 179A is released from the horizontal slot 178*a*A in the stationary condition of the sleeve 140A, on the other hand, a downward sliding movement of the operating member 162A results in lifting up only the support member 150A.

A first split half 121*a*A of the main body 120A has a first sliding piece 174 formed on an inner wall thereof, instead of the cam groove 172 of the second embodiment. The first sliding piece 174A is fitted in the cam groove 172A formed in the sleeve 140A. When the user slides down the operating member 162A to lift up the sleeve 140A, the position of the first sliding piece 174A moves down along a linear slot 172*b*A of the cam groove 172A from its upper end. With a further upward movement of the sleeve 140A, the first sliding piece 174A enters the cam slot 172*a*A. The upward movement of the sleeve 140A stops when the fist sliding piece 174A reaches the constricted element 172*d*A arranged on the lower end of the cam slot 172*a*A. The sleeve 140A then rotates by a predetermined angle, and the second sliding piece 179 is accordingly released from the horizontal slot 178*a*A of the guide groove 178A. Thereafter only the support member 150A further moves up with a downward sliding operation of the operating member 162A, in order to make the lipstick K protrude from the sleeve 140A and become ready for use.

As discussed above, in the lipstick case 110A of the third embodiment, the lifting mechanism 160A, which is similar to the lifting mechanism 160 of the second embodiment, functions to make the lipstick K protrude from the main body 120A. Like the second embodiment, an upward sliding movement of the operating member 162A allows the lipstick K to be accommodated into the main body 120A in reverse sequence.

The following describes the procedure of attaching and detaching the cartridge unit 182A to and from the main body 120A of the lipstick case 110A. When the cartridge unit 182A is to be detached from the main body 120A, the user first slides down the operating member 162A to its lower-most position and makes the sleeve 140A protrude from the main body 120A in the same manner as the second embodiment. The resulting state is the same as shown in FIG. 18. When the user pulls up the sleeve 140A under such conditions, the first sliding piece 174A comes off the cut 172*c*A on the lower end of the cam groove 172A while the second sliding piece 179A comes off the cut 178*c*A on the lower end of the guide groove 178A and the cut 175*c*A on the lower end of the connection hole 175A. This enables the sleeve 140A with the support member 150A attached therein to be readily pulled off the main body 120A.

When the cartridge unit 182A is to be attached to the main body 120A, the user presses the cartridge unit 182A into an inclined opening 122A of a tube 120*a*A of the main body 120A under the condition that the operating member 162A is kept at its lower-most position. The sleeve 140A is further provided with a check projection 142, which holds the support member 150A in a stationary condition and enables the connection hole 175A of the support member 150A to overlap with the horizontal slot 178*a*A of the guide groove 178A formed in the sleeve 140A. The cartridge unit 182A is pressed into the opening 122A of the main body 120A while the horizontal slot 178*a*A of the guide groove 178A is positioned at the joint of the first and second split halves 121*a*A and 121*b*A on the upper side of the inclined opening 122A. When the operating member 162A is kept in its lower-most position, the second sliding piece 179A formed on the second end of the belt 164A is located in the vicinity of the opening 122A of the tube 120*a*A. When the cartridge unit 182A is pressed into the main body 120A, the second sliding piece 179A is guided by the cuts 178*c*A and 175*c*A to pass through the horizontal slot 178*a*A of the guide groove 178A and to be fitted into the connection hole 175A. Since the support member 150A is fixed by the caulked element 154 as discussed previously, the second sliding piece 179A can be fitted into the connection hole 175A without making the support member 150A slide in the sleeve 140A.

The user then further presses the sleeve 140A into the tube 120*a*A while applying a predetermined rotating force to release the second sliding piece 179A from the horizontal slot 178*a*A. The caulking seat 152 on the support member 150A is then released from the engagement with the caulked element 154 of the sleeve 140A, so that the sleeve 140A is further pressed into the tube 120*a*A independently of the support member 150A. The position of the second sliding piece 179A, which is linked with the connection hole 175A of the support member 150A, in the guide groove 178A is shifted from the lower end to the upper end of the guide groove 178A. The support member 150A thus stops in the vicinity of the opening 122A.

When the user continues pressing down the sleeve 140A to move the position of the second sliding piece 179A from the lower end to the upper end of the guide groove 178A, the lower end of the sleeve 140A eventually reaches the position of the first sliding piece 174A on the main body 120A. While the second sliding piece 179A slides along the guide groove 178A, the first sliding piece 174A is located at the cut 172*c*A formed on the lower end of the cam groove 172A. A further pressing operation of the sleeve 140A enables the first sliding piece 174A to go over the constricted element 172*d*A and become fitted into the lower end of the cam slot 172*a*A with a moderate touch.

When the first sliding piece 174A is fitted in and engaged with the cam slot 172*a*A of the cam groove 172A, the user can not press down the sleeve 140A any further. An upward sliding movement of the operating member 162A here makes the support member 150A go down in the sleeve 140A. At this point, the sleeve 140A does not move but is kept in a stationary condition, and the position of the second sliding piece 179A is thereby shifted down in the guide groove 178A.

When the support member 150A with the lipstick K supported thereby is thoroughly accommodated in the sleeve 140A and the second sliding piece 179A reaches the horizontal slot 178*a*A of the guide groove 178A, the sleeve 140A is rotated by a predetermined angle according to the shape of the horizontal slot 178*a*A and the cam slots 172*a*A. Thereafter an upward sliding movement of the operating member 162A enables the support member 150A and the sleeve 140A to be lifted down together as a unit. The position of the first sliding piece 174A in the cam groove 172A is then shifted from the lower end to the upper end of the linear slot 172*b*A. When the operating member 162 is further slid up to its upper-most position, the support member 150A and the sleeve 140A are thoroughly received in the main body 120A. When the user presses down a cover 130A to close the opening 122A of the main body 120A under such conditions, the lipstick case 110A can be returned to its initial state (similar to the state of FIGS. 11(A) through 11(C)).

As discussed above, the lipstick case 110A of the third embodiment has the configuration of projection-recess engagement between the sleeve 140A and the main body 120A and between the support member 150A and the belt 164A, which is reverse to that of the lipstick case 110 of the second embodiment. The reverse configuration of projection-recess engagement can also realize the lifting mechanism 160A for quickly protruding the lipstick K from the main body 120A and the attachment mechanism for attaching and detaching the cartridge unit 182A to and from the main body 120A by simple pull-out and press-in operations.

In the second and the third embodiments described above, the cartridge unit 182 or 182A is attached to and detached from the main body 120 or 120A. In accordance with another possible structure given as a fourth embodiment of the present invention, however, a main body 120B itself can be attached to and detached from a casing 190.

Figure 23:
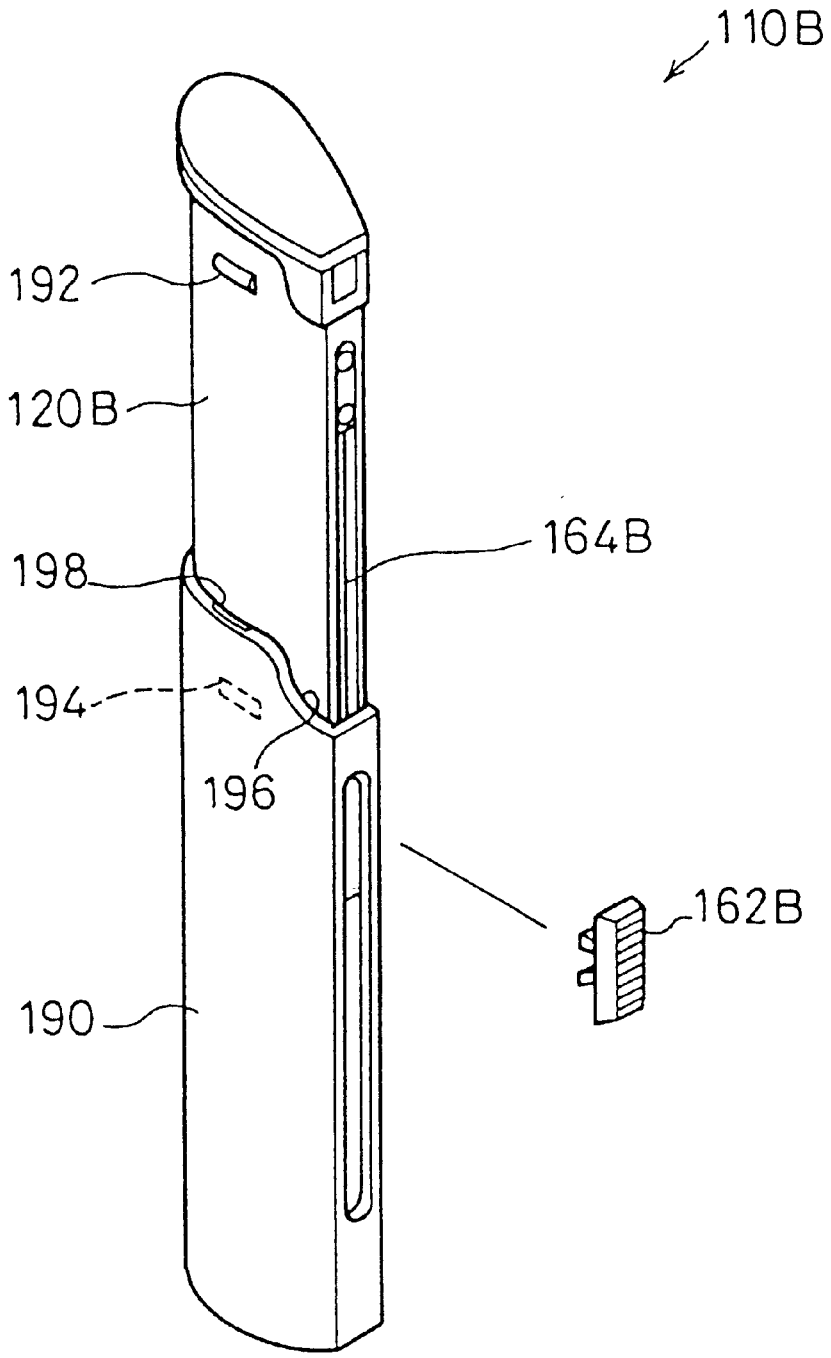
FIG. 23 shows structure of still another lipstick case 110B as a fourth embodiment according to the present invention.

FIG. 23 is a perspective view illustrating the appearance of a lipstick case 110B of the fourth embodiment. The lipstick case 110B of the fourth embodiment includes a main body 120B with a lifting mechanism, which is similar to the lifting mechanism 160 of the lipstick case 110 of the second embodiment, and a casing 190 for receiving the main body 120B therein. In the drawing of FIG. 23, the main body 120B of the lipstick case 110B is being inserted into the casing 190.

Unlike the lipstick case 110 of the second embodiment, in the lipstick case 110B of the fourth embodiment, an operating member 162B is freely detachable from a belt 164B incorporated in the main body 120B. After the main body 120B without the operating member 162B is inserted into the casing 190, the operating member 162B is attached to the main body 120B from the outside of the casing 190. The main body 120B has a click 192 at a predetermined position on the side wall thereof, whereas the casing 190 has a recess 194 formed on the inner wall thereof at a position corresponding to the click 192. The main body 120B is securely held in the casing 190 via the engagement of the click 192 with the recess 194.

When the lipstick K (not shown in FIG. 23) set in the lipstick case 110B has been used up, the user removes the operating member 162B from the casing 190, pulls the old main body 120B out of the casing 190, and inserts a new main body 120B into the casing 190. An opening 196 of the casing 190 has a guide slot 198 for guiding the click 192 in the course of attachment or detachment of the main body 120B. This structure eases the insertion and removal of the main body 120B into and from the casing 190.

In the replacement of the main body 120B, the operating member 162B connecting with the main body 120B (more concretely, with the belt 164B incorporated in the main body 120B) and protruded from the casing 190 is attached and detached independently of the insertion and removal of the main body 120B into and from the casing 190. This structure enables the main body 120B having the click 192 as the only protruded element to be readily inserted into and removed from the casing 190.

In the lipstick case 110B of the fourth embodiment, after the lipstick K has been used up, the main body 120B itself is removed from the casing 190 for replacement. This favorably simplifies the mechanism and operation relating to the attachment and detachment, compared with the attachment mechanism 180 of the second embodiment.

The main body 120B of the lipstick case 110B of the fourth embodiment may include a lifting mechanism identical with the lifting mechanism 60 of the main body 20 of the first embodiment, instead of the lifting mechanism 160 of the main body 120 of the second embodiment.

In the lipstick cases of the second through the fourth embodiments, the lifting mechanism (160, 160A) enables the lipstick K to be quickly protruded from and received into the main body via a simple sliding operation of the operating member. The lifting mechanism (160, 160A) of the embodiments function in the following manner. When the user slides down the operating member under the condition that the lipstick K is accommodated in the main body, the sleeve moves up and press-opens the cover on its upper end. After the upper end of the sleeve goes up beyond the ring projection formed on the cover, the lipstick K starts going up. This structure enables the lipstick K to be protruded from the main body without any additional action of opening the cover and effectively prevents the upper end face of the lipstick K from being pressed against the cover and damaged. Since the sleeve goes up to the position beyond the ring projection of the cover, the cover does not come into contact with the lipstick K while the user applies the lipstick K on the lips. In this manner, the lipstick K, except its upper portion protruded for application, is always protected by the sleeve. The sleeve not only protects the lipstick K protruded for application but the side face of the lipstick K received in the main body. Even when a certain impact is applied on the lipstick case in carriage, the sleeve receiving the whole length of the lipstick K effectively protects the lipstick K from damages.

In the above embodiments, the lipstick K is received into the main body by an upward sliding movement of the operating member toward the opening of the main body. The hinge for joining the cover with the main body is arranged on the same side as the operating member. This arrangement allows the user to smoothly proceed to the subsequent operation, that is, closing the cover, after sliding up the operating member to receive the lipstick K into the main body. The user can implement the series of operations quickly with only one finger. The engagement pawl formed on the ring projection of the cover is received in the engagement recess formed in the main body when the cover is closed. This engagement requires a moderate touch, thereby enabling the user to check that the cover is securely closed. Once the cover is closed, the engagement pawl can keep the cover in closed position.

In the above embodiments, the belt sliding groove, in which the belt is supported and moves in a sliding manner, is curved by a predetermined angle on the lower end of the main body to form a U shape. Application of a predetermined lubricant on both the faces of the belt keeps the frictional force generated between the belt and the belt sliding groove within a predetermined desirable range. This configuration enables the operating member to be slid up and down with a reasonable amount of force. The moderate frictional resistance prevents the lipstick from being unintentionally protruded while requiring no excessive force for the sliding operation of the operating member. Since the resistance generated in the sliding operation of the operating member is set in the predetermined range, the user can stop the protrusion of the lipstick at an arbitrary position. This allows a desired length of lipstick to be protruded from the main body irrespective of the length of the remaining lipstick. The resistance between the belt and the main body prevents the lipstick from being pressed back by a certain pressing force against the lipstick. The user can thus apply the lipstick directly on the lips.

In the lipstick cases of the second through the fourth embodiments, the belt is used as the interlocking unit for transmitting the sliding force applied to the operating member to the sleeve and the support member. Any other member may, however, be used for the same purpose as long as it can transmit the force applied to the operating member to the sleeve and the support member according to the shifted distance of the operating member.

In the lipstick cases of the above embodiments, the support member has a cup-like portion for supporting the lower end of the lipstick K. The lower end of the lipstick K is stuck in and fixed to the cup-like support member. The support member may, however, have any other desirable shape as long as it can effectively support and fix the lipstick K and be connectable with the predetermined interlocking unit, such as a belt, for transmitting the movement of the operating member. In accordance one possible structure, a cylindrical support member supports the lower side face of the lipstick K.

The lipstick cases of the second and the fourth embodiments have the lifting mechanism 160, whereas the lipstick case of the third embodiment includes the lifting mechanism 160A. Another configuration is also applicable to the projection-recess engagement between the sleeve and the main body and between the support member and the belt. By way of example, the first sliding piece is formed on the sleeve and the cam groove in the main body like the second embodiment, while the second sliding piece is formed on the belt and the connection hole in the support member like the third embodiment.

The lifting mechanism incorporated in the lipstick cases of the second through the fourth embodiments transmits the vertical sliding movement of the operating member to lift up and down the sleeve and the support member. As long as the operating member can transmit a predetermined operating force, which the user applies, to lift up and down the sleeve and the support member, the operating member may have any other structure that receives a predetermined operating force and moves in a different way from the vertical sliding movement.

In the above embodiments, a sliding operation of the operating member first lifts up the sleeve and the lipstick together as a unit, and then further lifts up only the lipstick while stopping and holding the sleeve at a predetermined position, thereby enabling the lipstick to be protruded from the upper end of the sleeve. The protrusion of the lipstick can also be implemented by making the sliding rate of the lipstick greater than the sliding rate of the sleeve. In accordance with one possible application, the sliding force of the operating member is transmitted to the sleeve via a single-start thread while being transmitted to the lipstick via a double-start thread. This makes the sliding rate of the lipstick greater than the sliding rate of the sleeve, thereby enabling the upper portion of the lipstick to be protruded from the sleeve after the sleeve is protruded from the opening of the main body.

In the above embodiments, a separate cover attached to the opening of the lipstick case is press-opened by an upward movement of the sleeve. Instead of attaching the cover, however, one end of the belt may be formed as a shutter. This modified structure opens and closes the opening of the main body with the shutter in response to the sliding movement of the operating member, thereby not requiring the cover formed as a separate member.

The hinge arranged at the joint of the cover with the main body may have an additional element for applying a spring force to the cover in the closing direction. This structure does not require the user to close the cover after accommodation of the lipstick K into the main body and further improves the convenience of use. In this case, however, the belt should be composed of a resilient material having a sufficient resistance to the stress a of spring force and an excellent durability.

In the above embodiments, the operating member is arranged on the same side as the hinge for joining the cover with the main body. The operating member may, however, be arranged at the position opposite to the hinge or at any other desirable position on the main body.

In the above description, the lipstick cases for receiving the lipstick K therein are given as the first through the fourth embodiments. The principle of the invention is, however, applicable to the cases of other stick-type cosmetic preparations, such as eye shadows, lip creams, and foundations (including makeup bases and skin-colored concealers or cover-ups). These stick-type cosmetic preparations can also be protruded from and accommodated into the corresponding cases by one action. When the structures of the second through the fourth embodiments are applied to such cases, predetermined cartridges including stick-type cosmetic preparations are replaceable.

Although the lipstick K, the sleeve, and the main body are formed to have inclined upper faces in the first through the fourth embodiments, the upper faces of the stick-type cosmetic preparations and their cases may have any other desirable shapes, such as horizontal.

There may be many other modifications, changes, and alterations without departing from the spirit or scope of the main characteristics of the present invention. It is thus understood that the above embodiments are only illustrative and not restrictive in any sense.

Industrial Application of the Invention

As discussed above, cases of stick-type cosmetic preparations and cartridges including stick-type cosmetic preparations according to the present invention can preferably be used in the field of manufacture and sale of beauty products.

What is claimed:

1. A case apparatus for storing a stick-type cosmetic preparation comprising a cosmetic preparation;

a support member configured to support the cosmetic preparation;

a sleeve member adapted to receive a protruding end portion of said cosmetic preparation therein;

a main body defining an elongated bore portion formed and dimensioned for receipt of said sleeve member and said support member with said stick-type cosmetic preparation through an opening therein;

a lift mechanism including a movable unit operably coupled to said support member and said sleeve to cause the combination thereof to reciprocate in said elongated bore in response to the movement of said movable unit to enable the protruding end portion of said stick-type cosmetic preparation to be protruded from said sleeve and said opening of said main body; and an attachment mechanism coupled between said cosmetic preparation and said main body for selective attachment and detachment therebetween.

2. The case apparatus as defined in claim 1, wherein said lift mechanism includes a transmitting unit operably coupling said movable unit to said sleeve member and said support member for said reciprocating movement in response to an operating force applied to the movable unit.

3. The case apparatus as defined in claim 2 wherein, said transmitting unit includes a belt having one end coupled to the movable unit and another end coupled with the sleeve member and the support member.

4. The case apparatus as defined in claim 3 wherein, said belt is sufficiently axially rigid to axially transmit a moving distance of said movable unit to said sleeve member and the support member.

5. The case apparatus as defined in claim 4 wherein, said belt is slidably coupled to said main body.

6. The case apparatus as defined in claim 2 wherein, said transmitting unit further includes:

a first guide mechanism having an engagement element formed on one of said sleeve member and said main body, a mating element formed on the other of said main body and said sleeve member, and adapted to slidably cooperate with said engagement element to enable said sleeve member to reciprocate along the bore portion of said main body, said mating element further including a cam portion configured to guide said engagement element to rotate said sleeve member in a predetermined direction prior to restricting a movement thereof, and a second guide mechanism coupled to said support member for sliding movement of said support member and said cosmetic preparation in response to the movement of said movable unit, upon the movement of said sleeve being restricted.

7. The case apparatus as defined in claim 6 wherein, said transmitting unit includes a belt having one end coupled to the movable unit and another end coupled with the sleeve member and the support member, and said second guide mechanism further comprises a connecting member adapted to connect said belt to said support member, and a guide groove formed along said sleeve member for sliding receipt of said connecting member therealong.

8. The case apparatus as defined in claim 7 wherein, said guide groove includes an engagement slot portion formed to urge said connecting member to release the sleeve member from the restricted movement by the rotation of said sleeve member, and a guide slot portion configured to guide said connecting member in a manner sliding said support member relative to said sleeve member while the movement of said sleeve being restricted.

9. The case apparatus as defined in claim 8 wherein, said attachment mechanism is formed and dimensioned to enable manual separation and joining of said engagement element and said connecting member with said mating element, and said belt, respectively.

10. The case apparatus as defined in claim 9 wherein, at least one of said engagement element and said connecting member resiliently coupled to said sleeve member and said support member, respectively.

11. The case apparatus as defined in claim 9 wherein, said main body defines a first guide cut configured to urge said connecting member coupled to said support member from said opening of said main body to a position proximate to said belt, and further defines a second guide cut configured to urge said engagement element from said opening of said main body into the elongated bore thereof.

12. The case apparatus as defined in claim 11 wherein, said first guide cut includes a projection positioned proximate to said belt.

13. The case apparatus as defined in claim 12 wherein, said first guide cut and said second guide cut are arranged corresponding to a distance between said engagement element and said connecting member fitted in said engagement slot portion of said guide groove.

14. The case apparatus as defined in claim 1 wherein, said lift mechanism is configured to slide up said sleeve preceding an upward movement of said cosmetic preparation therein until said sleeve member reaches at least said opening of said main body.

15. The case apparatus as defined in claim 14 wherein, said transmitting unit of said lift mechanism is adapted to transmit the movement of said movable unit to slidingly move said sleeve member to a predetermined position, and further move said support member with said cosmetic preparation supported thereby, while said sleeve member is stopped at the predetermined position, and enables said cosmetic preparation to be protruded from said sleeve member and said opening of said main body.

16. The case apparatus as defined in claim 14 wherein, said transmitting unit is further adapted to move up and down said cosmetic preparation at a predetermined sliding rate, which is greater then a sliding rate of said sleeve member.

17. The case apparatus as defined in claim 14 further including:

a cover attached to said main body at said opening between a closed position and an opened position, and said lift mechanism is configured to enable a protruding end of said sleeve member to urge said cover to the opened position.

18. The case apparatus as defined in claim 17 further including:

a biasing device to bias the cover toward the closed position.

19. The case apparatus as defined in claim 17 wherein, said lift mechanism is configured to accommodate said type cosmetic preparation and said sleeve member in the elongated bore of said main body in response to a movement of said movable unit to a position in the vicinity of said opening of said main body.

20. The case apparatus as defined in claim 14 further including:

a cover attached to said main body at said opening between a closed position and an opened position, said cover being operably coupled to said movable unit for movement between the opened position and the closed position in connection with the movement of said movable unit.

21. A cosmetic preparation cartridge apparatus for a stick-type cosmetic preparation case having an elongated bore formed and dimensioned for receipt of the cartridge through an opening therein, said cartridge comprising:

a support member adapted to support a stick-type cosmetic preparation;

a sleeve member adapted to receive at least a protruding end portion of said cosmetic preparation therein; and an attachment mechanism having a joint member coupled to at least one of the support member and the sleeve member, and a joint unit disposed on said main body, said joint member and said joint unit cooperate in a joined condition to releasably attach said cartridge to said main body;

wherein said joint member and said joint unit in the joined condition cooperate to form at least a portion of a lift mechanism adapted to selectively reciprocate said support member and said sleeve in said elongated bore of the cosmetic preparation case.

22. The cartridge apparatus in accordance with claim 21, wherein said support member includes a connecting member formed to connect with said support member, said sleeve member includes a guide groove adapted to guide said connecting member therealong, and a mating element slidably cooperating with a guiding element disposed in said main body.

23. The cartridge apparatus as defined in claim 22 wherein, said guide groove includes a guiding slot portion and an engaging slot portion in communication therewith, and said joint member includes said connecting member, which is joined with at least a portion of said joint unit formed in said main body, and said mating element, which mates with said guiding element, functions as another portion of said joint unit.

24. The cartridge apparatus as defined in claim 23 wherein, said sleeve member is formed and dimensioned to receive the length of said cosmetic preparation therein when a protruding end portion of said cosmetic preparation is received in said sleeve member.

25. The cartridge apparatus as defined in claim 23 further including:

a cap device formed and dimensioned to cover a protruding end of said sleeve member to protect a protruding end portion of said cosmetic preparation received in said sleeve member.

26. The cartridge apparatus as defined in claim 25 further including:

a protection member configured to be set inside said cap device.

27. The cartridge apparatus as defined in claim 25 wherein, said cap device is composed of a transparent material.

28. The cartridge apparatus as defined in claim 25 wherein, said cap device is adapted to be removed by a removal force applied on a circumference of said sleeve member in a direction toward the protruding end thereof, said removal force being less than a release force required to release the engagement of said joint unit with said joint member.

29. The cartridge apparatus as defined in claim 22 further including:

a support cover adapted to cover a bottom portion of said sleeve member to retain the connecting member linked with said support member and engaged with said engaging slot portion of said guide groove.

30. The cartridge apparatus as defined in claim 29 wherein, said support cover includes a first engagement slot formed for receipt of said mating element on said sleeve member, and a second engagement slot formed for receipt of said connecting member when said connecting member is guided through the guiding groove, and said first engagement slot and said second engagement slot being oriented substantially parallel to each other along a longitudinal axis of said sleeve member, and arranged to have a positional relationship substantially corresponding to a positional relationship between said connecting member set in said engaging slot and said mating element on said sleeve member.

31. A case apparatus for storing a stick-type cosmetic preparation comprising a support member configured to support the cosmetic preparation;

a sleeve member adapted to receive a protruding end portion of said cosmetic preparation therein;

a main body defining an elongated bore portion formed and dimensioned for receipt of said sleeve member and said support member with said stick-type cosmetic preparation through an opening therein;

a lift mechanism including a movable unit operably coupled to said support member and said sleeve to cause the combination thereof to reciprocate in said elongated bore in response to the movement of said movable unit to enable the protruding end portion of said stick-type cosmetic preparation to be protruded from said sleeve and said opening of said main body; and an attachment mechanism adapted to be coupled between said cosmetic preparation and said main body for selective attachment and detachment therebetween.

* * * * *

UNITED STATES PATENT AND TRADEMARK OFFICE
CERTIFICATE OF CORRECTION

PATENT NO. : 6,022,160

DATED : February 8, 2000

INVENTOR(S) : Tomio Sakurai

It is certified that error appears in the above-identified patent and that said Letters Patent are hereby corrected as shown below:

Column 34, line 6, change "stress a of" to --stress of --.

Signed and Sealed this

First Day of May, 2001

*Attest:*

Nicholas P. Godici

NICHOLAS P. GODICI

*Attesting Officer*

*Acting Director of the United States Patent and Trademark Office*